US008063858B2

(12) United States Patent
Ishizuka

(10) Patent No.: US 8,063,858 B2
(45) Date of Patent: Nov. 22, 2011

(54) ACTIVE MATRIX DISPLAY APPARATUS AND DRIVING METHOD THEREFOR

(75) Inventor: Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 838 days.

(21) Appl. No.: 12/096,350

(22) PCT Filed: Nov. 29, 2006

(86) PCT No.: PCT/JP2006/323802

§ 371 (c)(1),
(2), (4) Date: Jun. 5, 2008

(87) PCT Pub. No.: WO2007/066550

PCT Pub. Date: Jun. 14, 2007

(65) Prior Publication Data

US 2009/0167649 A1 Jul. 2, 2009

(30) Foreign Application Priority Data

Dec. 6, 2005 (JP) ..... 2005-351972

(51) Int. Cl.
*G09G 3/30* (2006.01)

(52) U.S. Cl. ..... 345/76; 345/55; 345/77; 345/204

(58) Field of Classification Search ..... None
See application file for complete search history.

(56) References Cited

U.S. PATENT DOCUMENTS

| | | | | |
|---|---|---|---|---|
| 2001/0045929 | A1 * | 11/2001 | Prache et al. | 345/89 |
| 2003/0142048 | A1 * | 7/2003 | Nishitani et al. | 345/82 |
| 2006/0043371 | A1 * | 3/2006 | Steer | 257/72 |

FOREIGN PATENT DOCUMENTS

| | | | |
|---|---|---|---|
| EP | 1 455 335 | A1 | 9/2004 |
| JP | 10-319908 | | 12/1998 |
| JP | 2003-5709 | | 1/2003 |
| JP | 2003-223136 | | 8/2003 |
| JP | 2003-241711 | | 8/2003 |
| JP | 2004-151194 | | 5/2004 |
| JP | 2005-208228 | | 8/2005 |
| JP | 2005-275003 | | 10/2005 |
| JP | 2005-326830 | | 11/2005 |
| JP | 2007-025523 | | 2/2007 |
| TW | 200525478 | A | 8/2005 |
| WO | 01/54107 | | 7/2001 |
| WO | 2004/036536 | | 4/2004 |

* cited by examiner

*Primary Examiner* — Amare Mengistu
*Assistant Examiner* — Antonio Xavier
(74) *Attorney, Agent, or Firm* — Drinker Biddle & Reath LLP

(57) ABSTRACT

A display includes connection lines each of which is provided for the corresponding scanning line of the display and is connected to a light emission element driving circuit, a ramp voltage generating section for generating ramp voltage for varying the control electrode voltage of each of the driver transistors relative to the voltage of the other electrode of the corresponding driver transistor to change the emission state of the corresponding light emission element, and a ramp voltage driver for supplying the ramp voltage to each of the connection lines provided for the corresponding scanning line in response to the scanning.

10 Claims, 19 Drawing Sheets

FIG.16

| SW | S1 | S2 | S3 |
|---|---|---|---|
| WRITING MODE | ON | ON | OFF |
| LIGHT EMISSION MODE | OFF | OFF | ON |

ACTIVE MATRIX DISPLAY APPARATUS AND DRIVING METHOD THEREFOR

BACKGROUND OF THE INVENTION

1. Field of the Invention

The present invention relates to a display apparatus including active elements for driving light emission elements such as EL (electroluminescent) elements and LEDs (light emission diodes) and its driving method, and more particularly to a display apparatus including thin film transistors (TFTs) as active elements and the driving method therefor.

2. Description of the Related Art

TFTs are widely used as active elements for driving an active matrix display such as an organic EL display and a liquid crystal display. FIG. 1 shows a pixel PLi,j in an example of an equivalent circuit of a driving circuit in an organic EL (organic electroluminescent) element (OEL) or an organic light emission diode (OLED) 100.

As illustrated in FIG. 1, the equivalent circuit includes two p-channel TFTs 101 and 102 as active elements and a capacitor (Cs) 104. A scanning line Ws is connected to the gate of the selector TFT 101. A data line Wd is connected to the source of the selector TFT 101. A power supply line Wz for supplying constant supply voltage Vdd is connected to the source of the driver TFT 102. The drain of the selector TFT 101 is connected to the gate of the driver TFT 102. The capacitor 104 is provided between the gate and the source of the driver TFT 102. The anode of the OEL 100 is connected to the drain of the driver TFT 102, and the cathode of the OEL 100 is connected to the ground voltage (or common voltage).

When a selecting pulse is applied to the scanning line Ws, the selector TFT 101 as a switch is turned on and the selector TFT 101 becomes conductive across its source and drain. Simultaneously, data voltage is supplied through the connection between the source and drain of the selector TFT 101 from the data line Wd and accumulated in the capacitor 104. The data voltage accumulated in the capacitor 104 is applied between the gate and source of the driver TFT 102. As a result, drain current Id corresponding to gate-source voltage Vgs of the driver TFT 102 is generated and supplied to the OEL 100, and the OEL 100 having received the drain current Id emits light.

The active matrix display having this structure displays images by supplying data signals corresponding to input video data to the respective pixels PLi,j via the data lines while sequentially applying selecting pulses (scanning pulses) to the respective scanning lines.

However, the known active matrix display holds display data for a period of one frame. This type of display is referred to as a hold-type display apparatus.

When the display continues image display while holding the display data for the frame period, the image display quality, particularly the image display quality of the moving images display, is deteriorated. That is, contours of images are blurred and recognized as blurred images, or false contour noise is generated.

For overcoming these drawbacks, for example, Japanese Patent Applications Kokai No. 2003-223136 and No. 2003-5709 disclose structures for stopping light emission from light emission elements for a predetermined time in a frame period.

SUMMARY OF THE INVENTION

The present invention has been developed to solve the problems arising from the active matrix displays discussed above and shown in the above references, for example. According to the driving circuits and methods disclosed in the above related art, references and others, the circuit structures and operations are complicated, and the advantages offered thereby are limited. Moreover, there are limitations to light emission period and non-emission period of the light emission elements and their emission timing, and thus the light emission driving cannot be freely controlled.

It is an object of the present invention to provide an active matrix display apparatus and the driving method therefor capable of reducing image quality deterioration and false contour noise which cause blurs of image contours in image display, particularly in moving images display, so as to achieve high-quality image display. It is another object of the present invention to provide an active matrix display apparatus and the driving method therefor having simplified circuit structure and operation with low power consumption.

A display apparatus of the present invention includes: an active matrix display panel containing light emission element driving circuits having capacitors for holding a data signal and driver transistors for driving light emission elements based on data signal voltage held by the capacitors, and a plurality of pixel units each of which has the corresponding light emission element and is arranged in matrix with lines and rows; a scanning driver for sequentially scanning each of scanning lines provided for the corresponding line of the pixel units; and a data driver for supplying the data signal to the pixel units via data lines in response to scanning by the scanning driver. The display apparatus further includes: connection lines each of which is provided for the corresponding scanning line of the display panel and is connected to the corresponding light emission element driving circuit; a ramp voltage generating section for generating ramp voltage which varies the control electrode voltage of the driver transistor relative to the voltage of the other electrode of the driver transistor to change the light emission state of the light emission elements; and a ramp voltage driver for supplying the ramp voltage to each of the connection lines provided for the corresponding scanning line in response to the scanning of the scanning line.

A driving method of the present invention is a driving method for a display apparatus which includes: an active matrix display panel having a plurality of pixel units each of which has a light emission element, a capacitor for holding a data signal, and a driver transistor for driving the light emission element based on data signal voltage held by the capacitor and is arranged in matrix with lines and rows; a scanning driver for sequentially scanning each of scanning lines provided for the corresponding line of the pixel units; and a data driver for supplying the data signal to the pixel units via data lines in response to scanning by the scanning driver. This driving method includes: a step of controlling the capacitors such that the capacitors hold voltage indicated by the data signal; and a light emission control step of varying the light emission states of the light emission elements by changing the control electrode voltage of each of the driver transistors provided for the corresponding scanning line relative to the voltage of the other electrode of the corresponding driver transistor in response to the scanning of the scanning lines of the display panel.

BRIEF DESCRIPTION OF THE DRAWINGS

FIG. 16 shows connection and disconnection of the switches SW1 through SW3 in a data writing mode and a light emission mode.

DETAILED DESCRIPTION OF THE INVENTION

Figure 1:
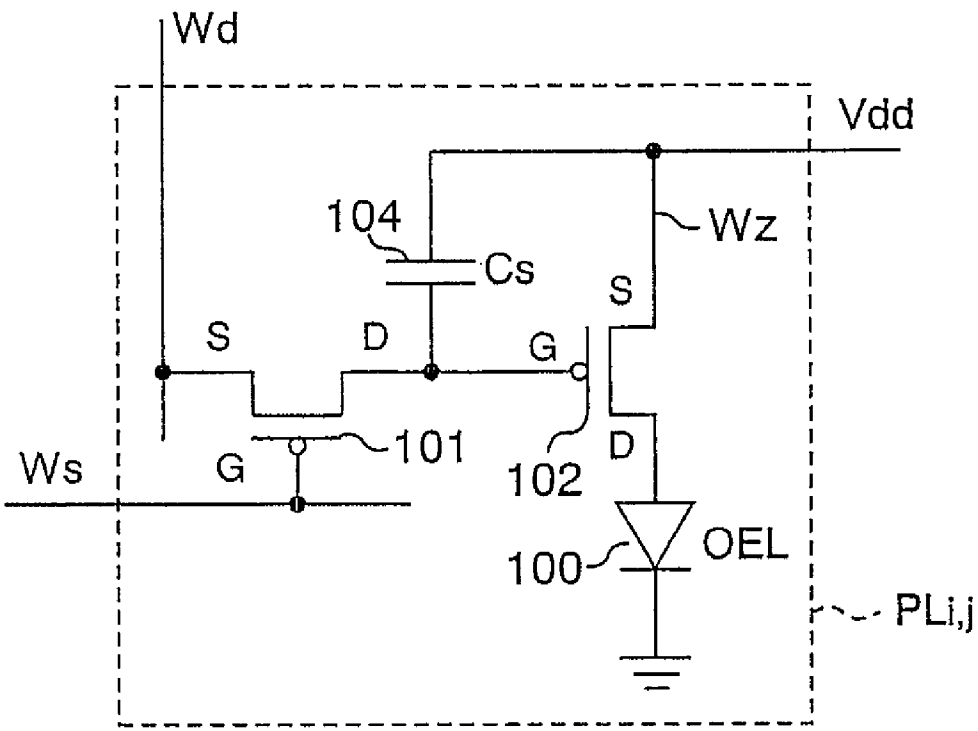
FIG.1 RELATED ART
FIG. 1 illustrates an example of an equivalent circuit of a light emission element driving circuit of a related art.

Preferred embodiments of the present invention are hereinafter described with reference to the accompanying drawings. In the drawings, similar reference numbers are given to substantially similar or equivalent components and parts.

First Embodiment

Figure 2:
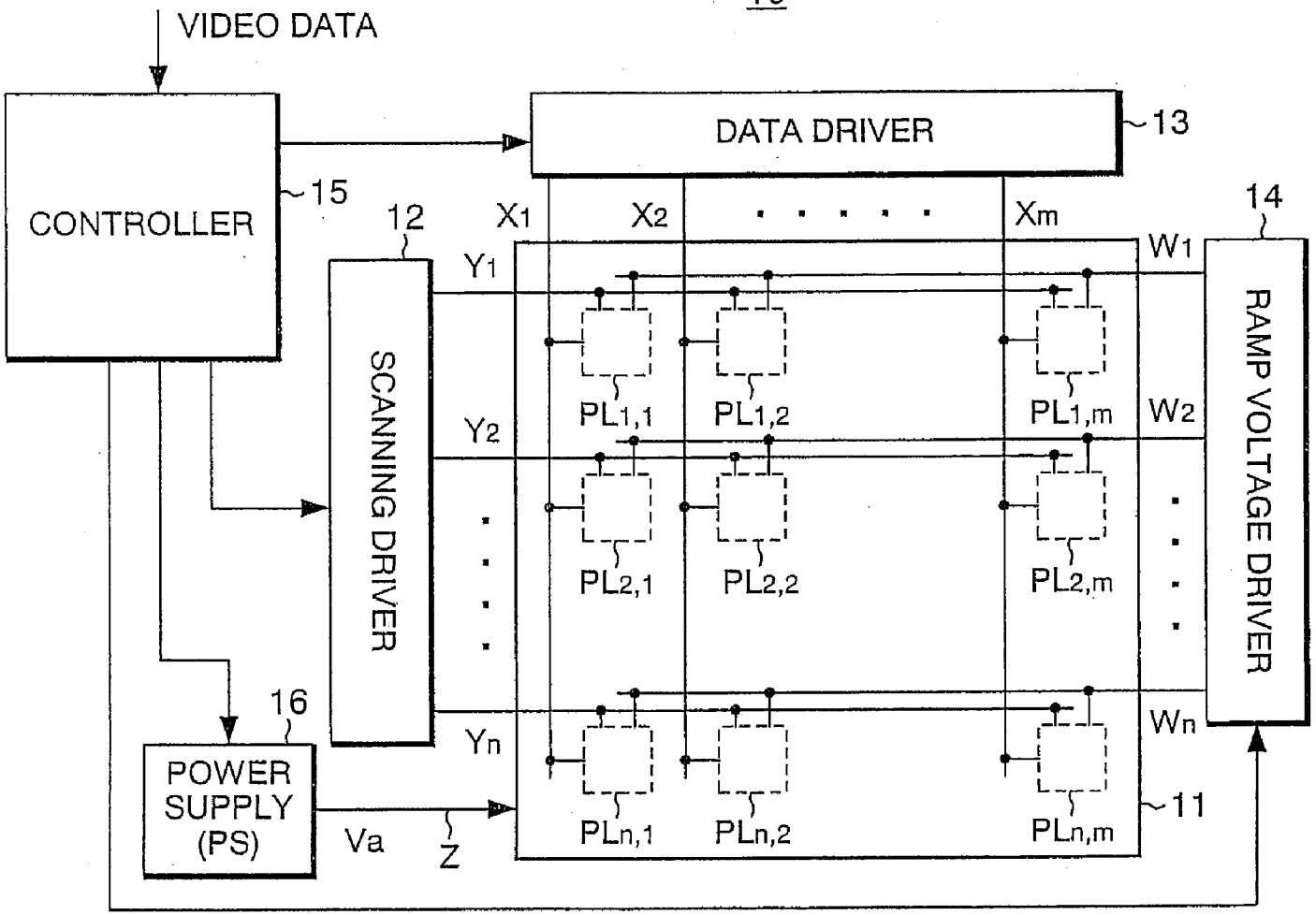
FIG. 2 is a block diagram showing a structure of a display apparatus having an active matrix display panel according to a first embodiment of the present invention.

FIG. 2 illustrates a display apparatus 10 which uses an active matrix display panel according to a first embodiment of the present invention. The display apparatus 10 includes a display panel 11, a scanning driver 12, a data driver 13, a ramp voltage driver 14, a controller 15, and a light emission element driving power supply PS (hereinafter, simply referred to as power supply PS) 16.

The display panel 11 is an active matrix display panel constituted by m×n pixels (m, n: 2 or larger integers). The display panel 11 has a plurality of data lines X1 through Xm (Xi: i=1 through m) each of which is disposed in parallel with each other, a plurality of scanning lines Y1 through Yn (Yj: j=1 through n) each of which is disposed in parallel with each other, and a plurality of pixel units $PL_{1,1}$ through $PL_{n,m}$. The pixel units $PL_{1,1}$ through $PL_{n,m}$ are disposed at the cross points of the data lines X1 through Xm and the scanning lines Y1 through Yn, and have the same structure. The pixel units $PL_{1,1}$ through $PL_{n,m}$ are connected to a power supply line Z. The power supply line Z receives light emission element driving voltage (Va) from the power supply (PS) 16.

The display panel 11 has connection lines (ramp voltage supply lines) W1 through Wn each of which is associated with the corresponding one of the scanning lines Y1 through Yn. Each of the ramp voltage supply lines (hereinafter, simply referred to as ramp voltage lines) W1 through Wn is provided for the corresponding scanning line as a common connection line for each scanning line. As will be described later, each of the ramp voltage lines W1 through Wn receives ramp voltage (slope voltage) from the ramp voltage driver 14 with predetermined timing.

Figure 3:
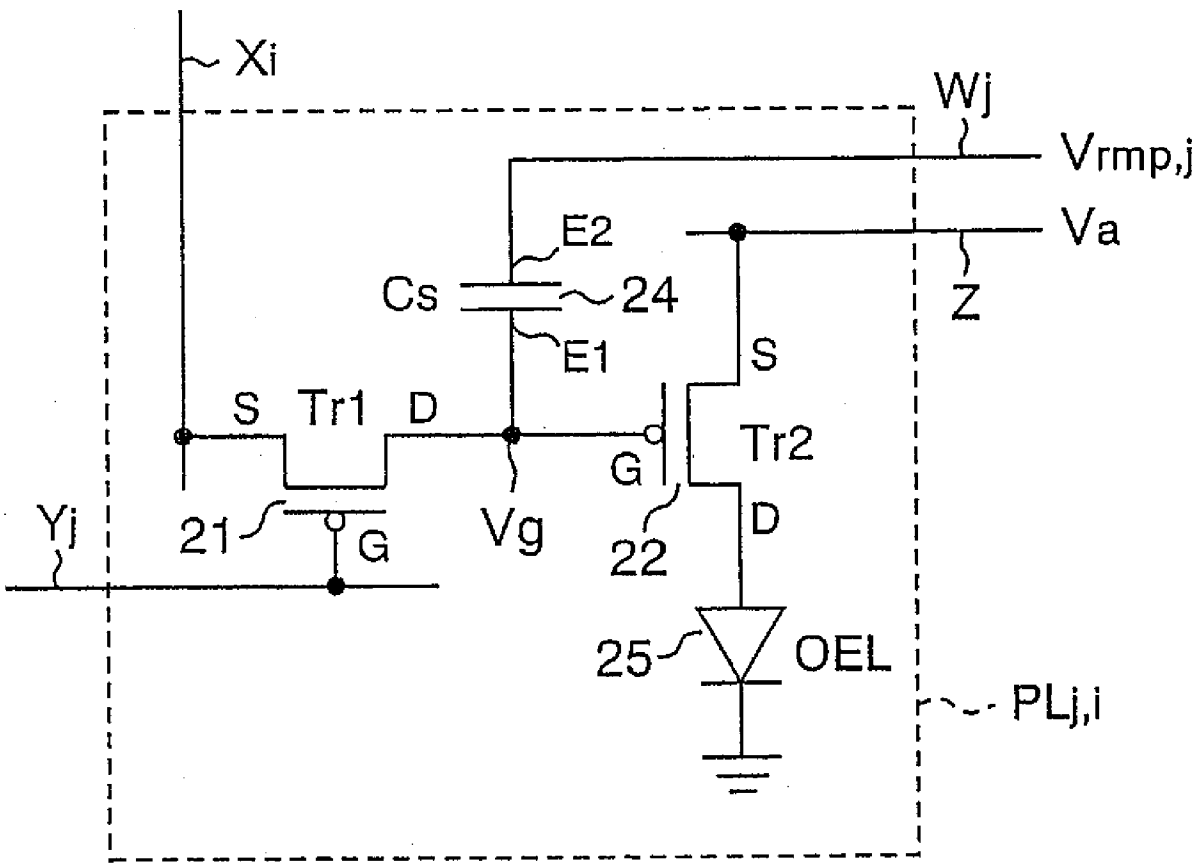
FIG. 3 illustrates a structure of a pixel unit $PL_{j,i}$ associated with a data line Xi and a scanning line Yj in a plurality of pixel units of the display panel.

FIG. 3 illustrates the pixel unit $PL_{j,i}$ associated with the data line Xi (i=1, 2, through m) and the scanning line Yj (j=1, 2 through n) in the plurality of pixel units of the display panel 11. The pixel unit $PL_{j,i}$ is connected to the data line Xi and scanning line Yj. More specifically, the pixel unit $PL_{j,i}$ has TFTs (thin film transistors) 21 and 22 as selector transistor (Tr1) and driver transistor (Tr2), respectively, a data holding capacitor (Cs) 24, and an organic EL (electroluminescence) light emission element (OEL) 25. The selector transistor, the driver transistor and the capacitor 24 constitute a driving circuit of the light emission element 25. In this example, the two TFTs 21 and 22 are P-channel TFTs.

The gate of the selector TFT (Tr1) 21 is connected to the scanning line Yj, and the source of the TFT 21 is connected to the data line Xi. The drain of the selector TFT 21 is connected to the control electrode (i.e., gate) of the driver TFT (Tr2) 22. The source of the TFT 22 is connected to the power supply line Z so as to receive power supply voltage (positive voltage Va) from the power supply 16. The drain of the TFT 22 is connected to the anode of the EL element 25. The cathode of the EL element is connected to the ground.

In the embodiment, one end of the capacitor (Cs) 24 (first terminal; electrode E1) is connected to the gate of the driver TFT as the control electrode (and the drain of the selector TFT21). The other end of the capacitor 24 (second terminal; electrode E2) is connected to the ramp voltage driver 14 via the ramp voltage line Wj. Thus, the respective capacitors (Cs) 24 associated with the corresponding scanning lines Yj are connected such that ramp voltage Vrmp, j which varies with time with predetermined slope or gradient is applied from the ramp voltage driver 14 to the capacitors (Cs 24) via the respective ramp voltage lines W1 through Wn. For simplifying the description, the ramp voltage Vrmp,j is also referred to as Vrmp.

The scanning lines Y1 through Yn of the display panel 11 are connected to the scanning driver 12, and the data lines X1 through Xm are connected to the data driver 13. The controller 15 generates scanning control signals and data control signals for the gray scale driving control of the display panel 11 in accordance with an input image signal or video signal. The scanning control signals are supplied to the scanning driver 12, and the data control signals are supplied to the data driver 13.

The scanning driver 12 supplies display scanning pulses to the scanning lines Y1 through Yn with predetermined timing in accordance with the scanning control signals transmitted from the controller 15 for a-line-at-a-time scanning or line sequential scanning.

The data driver 13 supplies pixel data signals, which are associated with the respective pixel units positioned on the scanning lines to which the scanning pulses are supplied, to the pixel units (selected pixel units) through the data lines X1 through Xm in accordance with the data control signals transmitted from the controller 15. The data driver 13 supplies pixel data signals at a level not causing light emission from the EL elements to the non-light-emission pixel units. Thus, the image display of the display panel 11 is controlled by applying data signals indicating light emission luminance of the respective pixels via the data lines X1 through Xm in response to the line-at-a-time scanning or line sequential scanning.

The controller 15 controls the entire apparatus of the display apparatus 10 including the scanning driver 12, the data driver 13, the ramp voltage driver 14, and the light emission element driving power supply 16. As discussed above, the ramp voltage driver 14 applies ramp voltage Vrmp,j to the ramp voltage line Wj. The ramp voltage driver 14 includes functions as a ramp voltage generating section for generating voltage (ramp voltage Vrmp) applied to the ramp voltage line Wj, a ramp voltage controlling section for controlling the ramp voltage Vrmp, and a ramp voltage driver for supplying the ramp voltage.

Figure 4:
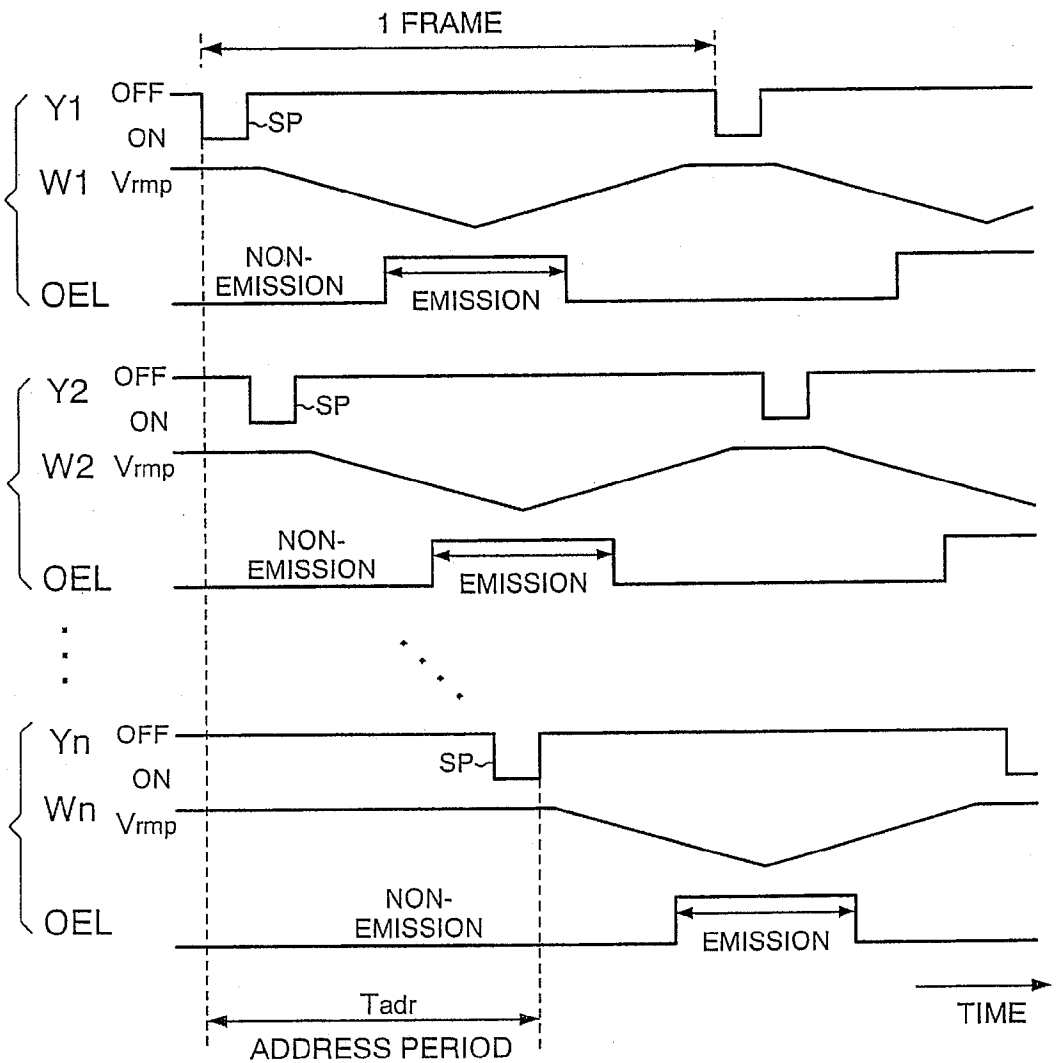
FIG. 4 is a timing chart schematically showing timing for applying scanning pulse to each of scanning lines Y1 through Yn and ramp voltage Vrmp applied to ramp voltage lines W1 through Wn, and light emission states of light emission elements (OEL)

FIG. 4 is a timing chart which schematically shows timing for applying scanning pulses to the respective scanning lines Y1 through Yn and ramp voltage Vrmp to the respective ramp voltage lines W1 through Wn in the display panel 11, and the light emission states (i.e., emission state and non-emission state) of the light emission element (OEL) 25.

In the respective frames of the input video signal, scanning pulses SP for selecting scanning lines are sequentially applied to the first through the n-th scanning lines (Y1 through Yn) to perform a line sequential scanning. Data voltage (not shown) is supplied from the data driver 13 at the time of selection of the scanning lines (scanning pulse SP is ON), and pixel data is written. The writing period (or address period: Tadr) continues from the beginning till the end of the data writing (scanning) to the pixels on the first through the n-th scanning lines (Y1 through Yn).

More specifically, after elapse of a predetermined time ($t0 \geqq 0$) from the end of writing to the pixels $PL_{1,1}$ through $PL_{1,m}$ on the first scanning line (Y1) in the line sequential scanning, the ramp voltage driver 14 sweeps the ramp voltage Vrmp,1 applied to the ramp voltage line W1 corresponding to the first scanning line. As will be described later in detail, the state of the light emission element (OEL) 25 changes from non-emission to emission in accordance with the level of the ramp voltage Vrmp,1 and then further changes from an emission state to a non-emission state.

Similar processes are performed for the second scanning line (Y2). After elapse of the predetermined time ($t0 \leqq 0$) from the end of writing to the pixels on the corresponding scanning line, the ramp voltage drier 14 sweeps ramp voltage Vrmp,2 on the ramp voltage line W2. The ramp voltage Vrmp,2 has the same voltage profile as that of the ramp voltage Vrmp,1 applied to the first scanning line W1.

Similar processes are performed for the third through the n-th scanning lines (Y3 through Yn). After writing to the pixels on these scanning lines is finished, ramp voltages Vrmp,3 through Vrpm,n are swept on the ramp voltage lines W3 through Wn.

Figure 5:
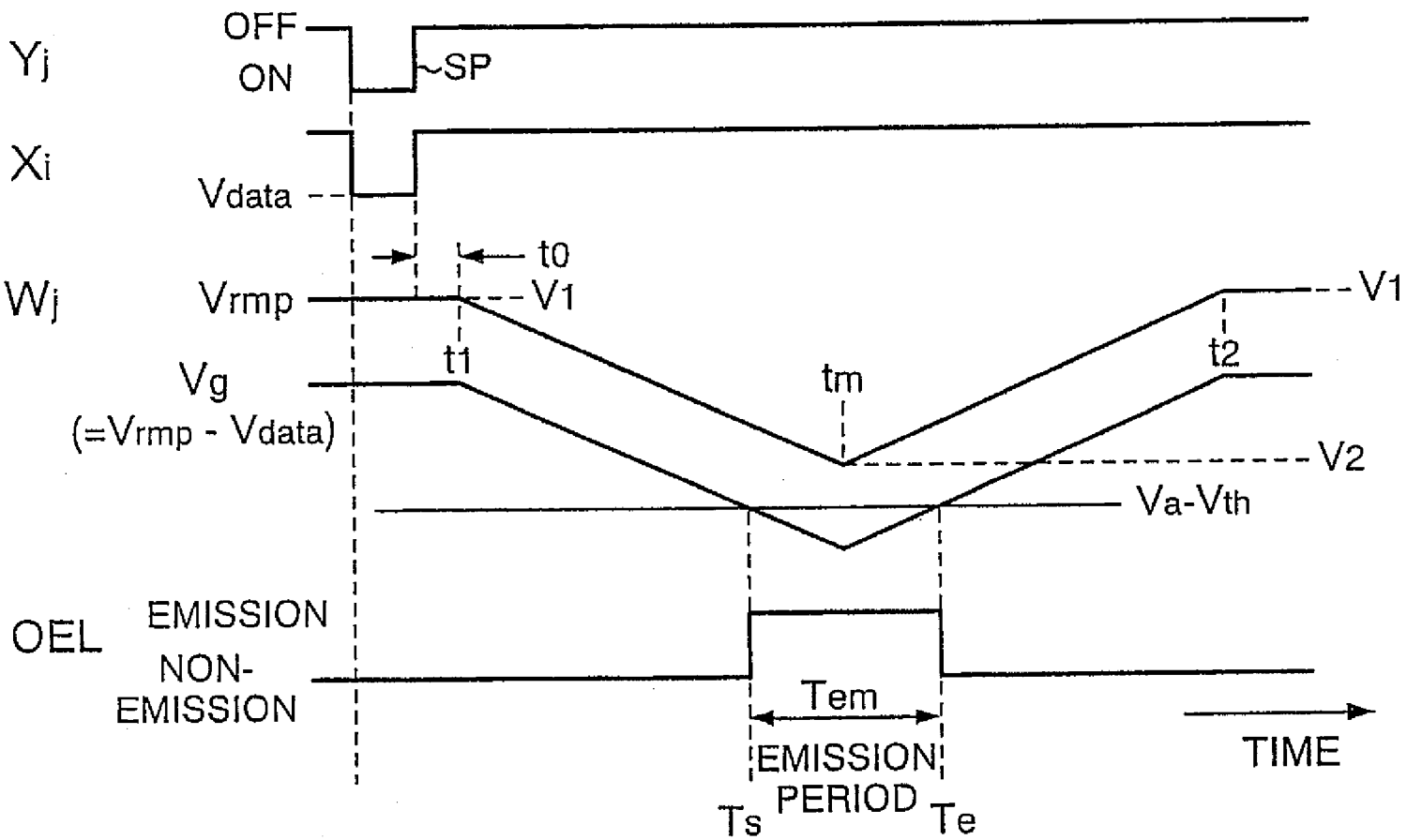
FIG. 5 is a timing chart schematically showing voltage applied to each of lines Yj, Xi and Wj of the pixel unit $PL_{j,i}$ the ramp voltage Vrmp, gate voltage Vg of a driver TFT, and a light emission state of the light emission element.

The details of the light emission control are now discussed. FIG. 5 shows voltages applied to the respective lines Yj, Xi, and Wj of the pixel $PL_{j,i}$, the ramp voltage Vrmp,j, the gate voltage Vg of the driver TFT (Tr2) 22, and the light emission states of the light emission element (OEL) 25. A typical example of the pixel unit $PL_{j,i}$ (j=1 through n, i=1 through m) is described with reference to FIG. 5.

When scanning pulse SP is applied to the j-th scanning line Yj (scanning pulse SP is ON), the selector TFT 21 is turned on, thus the scanning line Yj is selected. As a result, a data signal DP (data voltage Vdata) corresponding to the luminance of the pixel $PL_{j,i}$ from the data driver 13 is supplied to the gate of the driver TFT 22 (first terminal: electrode E1) via the selector TFT 21. Since the lamp voltage Vrmp is applied to the second terminal of the capacitor 24 (electrode E2) via the ramp voltage line Wj, electric charges corresponding to the voltage Vrmp−Vdata are accumulated in the capacitor 24 and thus the voltage is held. Drain current corresponding to the gate-source voltage Vgs flows in the driver TFT 22.

Figure 7:
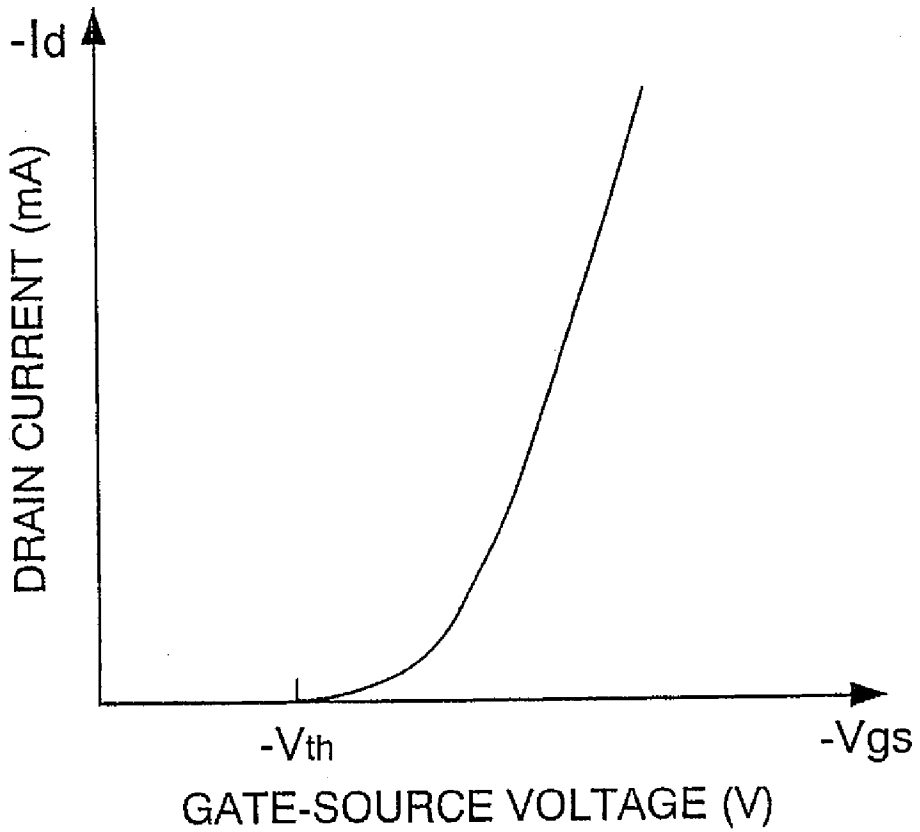
FIG. 7 is a graph showing characteristics of drain current (Id) against gate-source voltage Vgs of the driver transistor.

FIG. 7 shows characteristics (Id-Vgs characteristics) of drain current (Id) against the gate-source voltage Vgs of the driver TFT 22. As shown in the figure, assuming that the threshold of the driver TFT (Tr2) 22 is −Vth (Vth>0), current (Id) flows in the driver TFT 22 when −Vgs<−Vth. As a result, the light emission element (OEL) 25 is actuated and emits light. That is, the light emission element (OEL) 25 emits light when −Vgs=(Vrmp−Vdata)−Va<−Vth.

Referring to FIG. 5 again, sweep of the ramp voltage Vrmp is initiated from the end of writing to the pixel $PL_{j,i}$ or from the voltage V1 at a time t1 after elapse of the predetermined time from the end of the writing. Then, current starts flowing in the driver TFT22 from the time (Ts) when the above condition Vrmp−Vdata<Va−Vth is satisfied, and thus the light emission element (OEL) 25 starts emitting light. The sweep of the ramp voltage Vrmp is reversed from the voltage V2 to the voltage V1 at a time of tm (Vrmp=V2). Thereafter, the light emission element (OEL) 25 keeps emitting light until a time (Te) when the above condition is not satisfied, and then the light emission element (OEL) 25 stops light emission. Thus, the light emission element (OEL) 25 maintains light emission for the light emission period (length of light emission period Tem) from the light emission start time Ts to the light emission end time Te.

Figure 6:
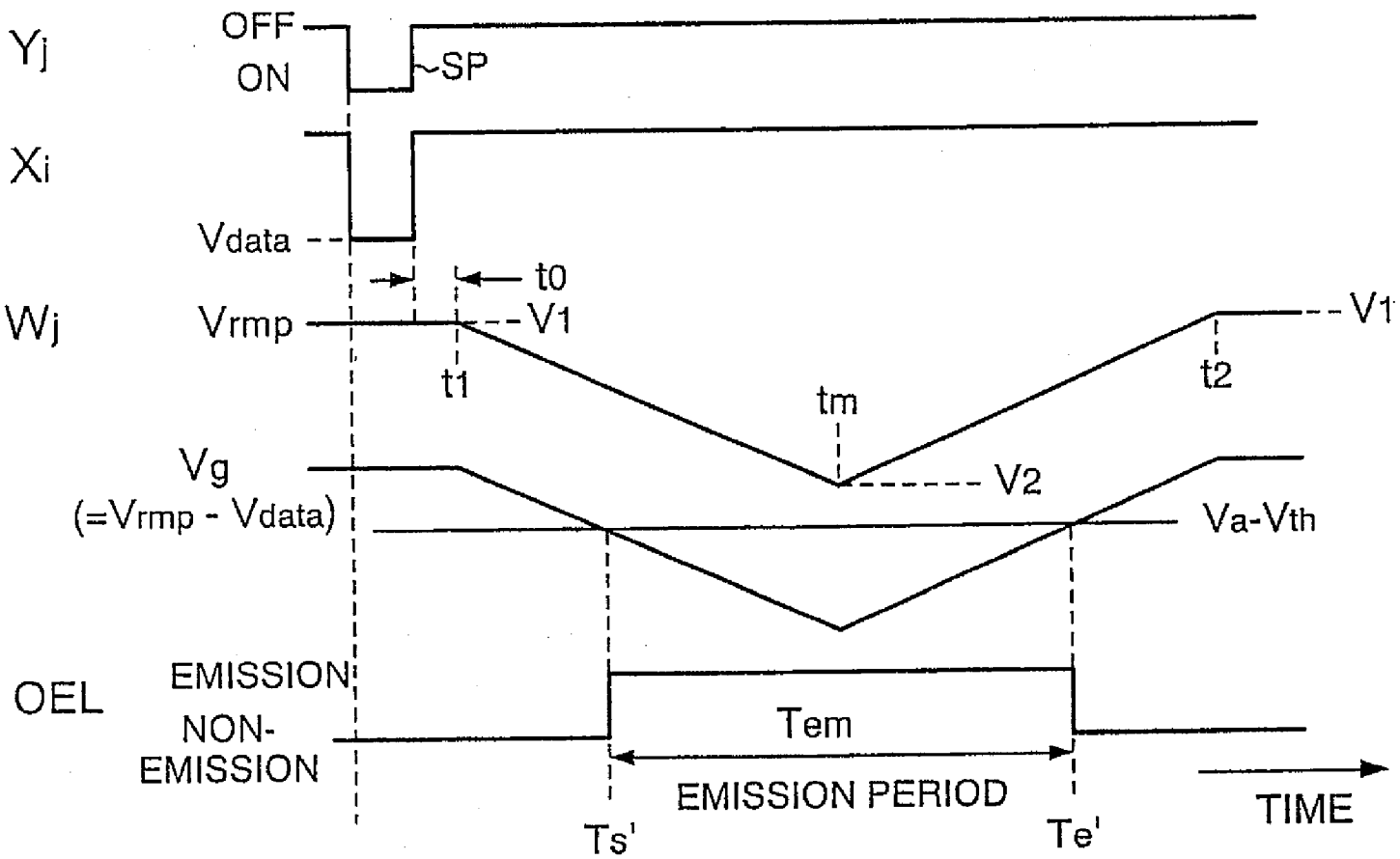
FIG. 6 is a timing chart schematically showing the respective states when data having a longer light emission period (higher luminance) than that in the case shown in FIG. 5 is written.

FIG. 5 schematically shows a case where data having a short light emission period (having low luminance), i.e., data having small data voltage for indicating luminance is written. FIG. 6 schematically shows a case where data having long light emission period (having high luminance) is written. In this case, the same ramp voltage Vrmp as in the case shown in FIG. 5 is applied to the ramp voltage line. That is, the ramp voltage Vrmp sweeping from the voltage V1 (time t1) to the voltage V2 (time tm) and further sweeping from the voltage V2 at time tm to the voltage V1 (time t2) is applied to the ramp voltage line. In this case, however, the data voltage (Vdata) indicating luminance is larger than that in the case shown in FIG. 5. Thus, the light emission starts at a time (light emission start time Ts') before the light emission start time Ts in the case of FIG. 5, and stops at a time (light emission end time Te') after the light emission end time Te in the case of FIG. 5. Accordingly, the length of light emission period Tem can be controlled in accordance with the level of the data voltage Vdata.

The light emission periods of the respective pixels (light emission elements) differ depending on the levels of the data voltages Vdata supplied to those pixels even if those pixels are positioned on the same scanning line. The ramp voltage driver 14 functioning also as the ramp voltage generating section and a ramp voltage controlling section determines the ramp voltage such that the total light emission amount during the light emission period corresponds to the luminance indicated by the data signal (data voltage) under the control of the controller 15. Thus, the luminance and gray scale are controlled by this function of the ramp voltage driver 14.

As discussed above in detail, the light emission period can be controlled for each of the ramp voltage lines W1 through Wn (scanning lines) by applying the ramp voltage Vrmp to each of the ramp voltage lines W1 through Wn each of which is provided for the corresponding scanning line. By this control, the display data is not required to be held for the frame period, and therefore image quality deterioration and false contour noise which cause blurs of image contours in image display, particularly in moving images display, can be reduced.

Moreover, since the ramp voltage line is provided for each of the scanning lines, ramp voltage can be applied before the end of the writing (scanning) of data to the pixels on all the scanning lines. Thus, as shown in FIG. 4, the light emission elements of the pixels connected to the scanning lines to which the data writing is finished can emit light even within the writing period (or address period: Tadr).

In other words, it is not necessary to separate the writing period (address period) and the light emission period. Thus, the light emission period during which the light emission elements emit light is prolonged compared with the light emission period in the case where the writing period and the light emission period are separated, and this prolongation of the light emission increases the luminance. Accordingly, the display apparatus can achieve high-performance luminance control such as high-accuracy luminance control with high luminance and low power consumption while offering the above advantage of eliminating image quality deterioration. Furthermore, the display apparatus has simplified circuit structure and operation.

In the description of the embodiment, the types and polarities of the transistors and the light emission elements and the levels and polarities of the scanning pulse SP, data voltage Vdata and ramp voltage Vrmp, and other conditions are only examples shown for the purpose of explanation. The polarities of the elements, the levels and polarities of the voltage and other conditions selected may be others as long as the switching of the driver transistor (Tr2) is controlled and the emission and non emission states of the light emission elements are switched in accordance with the level of the data voltage Vdata and the sweep of the ramp voltage Vrmp so as to control the length of the light emission period of the light emission elements in accordance with the levels of the data signals (data voltage Vdata).

In this embodiment, the gate voltage of the driver transistor (Tr2) is varied by applying the ramp voltage Vrmp,j to the second terminal (E2) of the capacitor 24 via the lamp voltage line Wj (j=1 through n). The power supply 16 applies constant voltage (Va) to the source of the driver transistor (Tr2) via the power supply line Z. Thus, the switching of the driver transistor (Tr2), i.e., the switching of the light emission state can be controlled by varying the gate to source voltage (gate-source voltage Vgs) of the driver transistor (Tr2).

Figure 8:
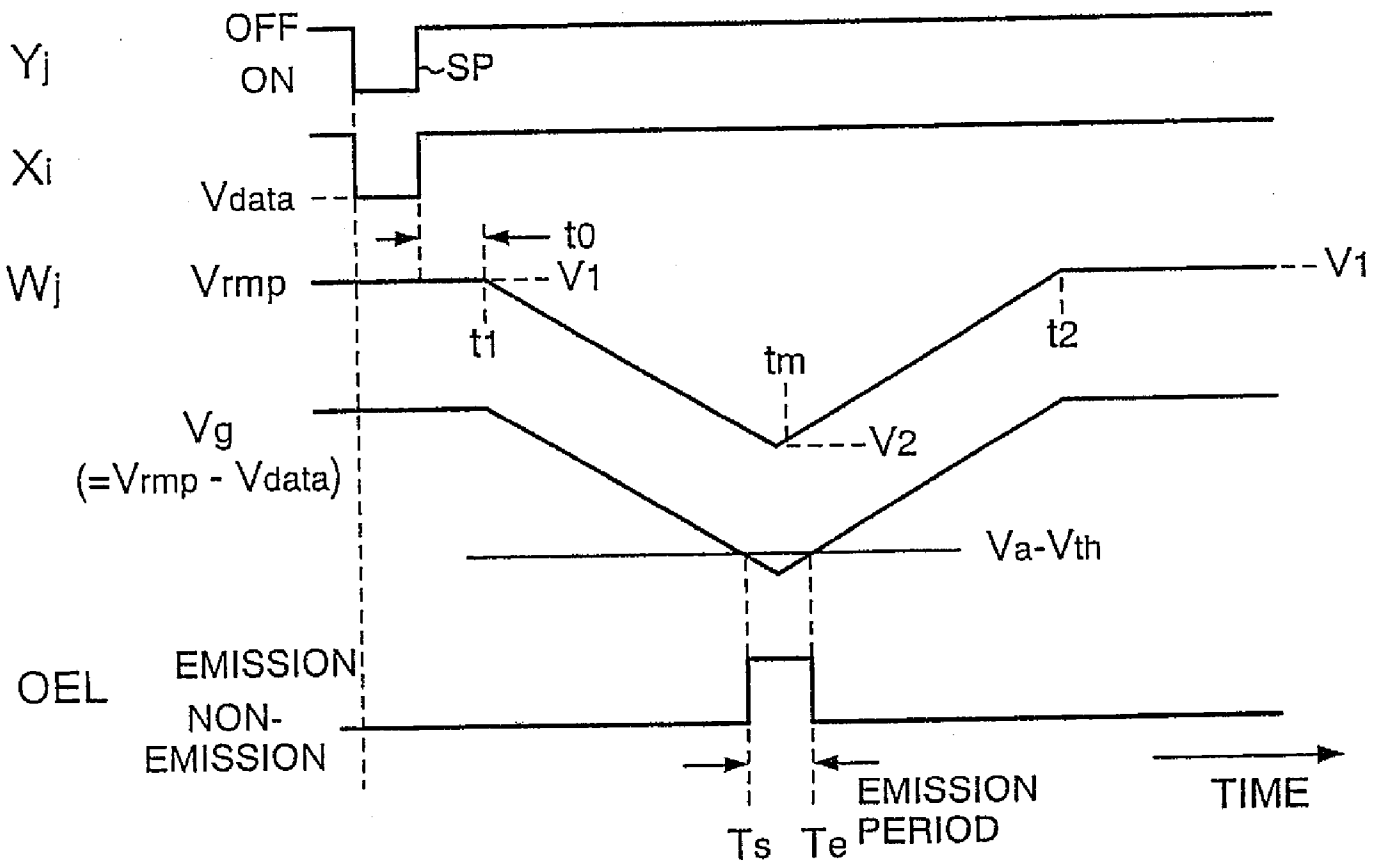
FIG. 8 schematically illustrates light emission control when data voltage Vdata indicates low luminance.

As discussed above, the ramp voltage Vrmp has a triangular-wave profile. Thus, when the data voltage Vdata indicates low luminance as shown in FIG. 8, for example, fine and accurate light emission control can be achieved in accordance with the luminance. Accordingly, driving of the light emission elements and control over luminance can be facilitated.

Figure 9:
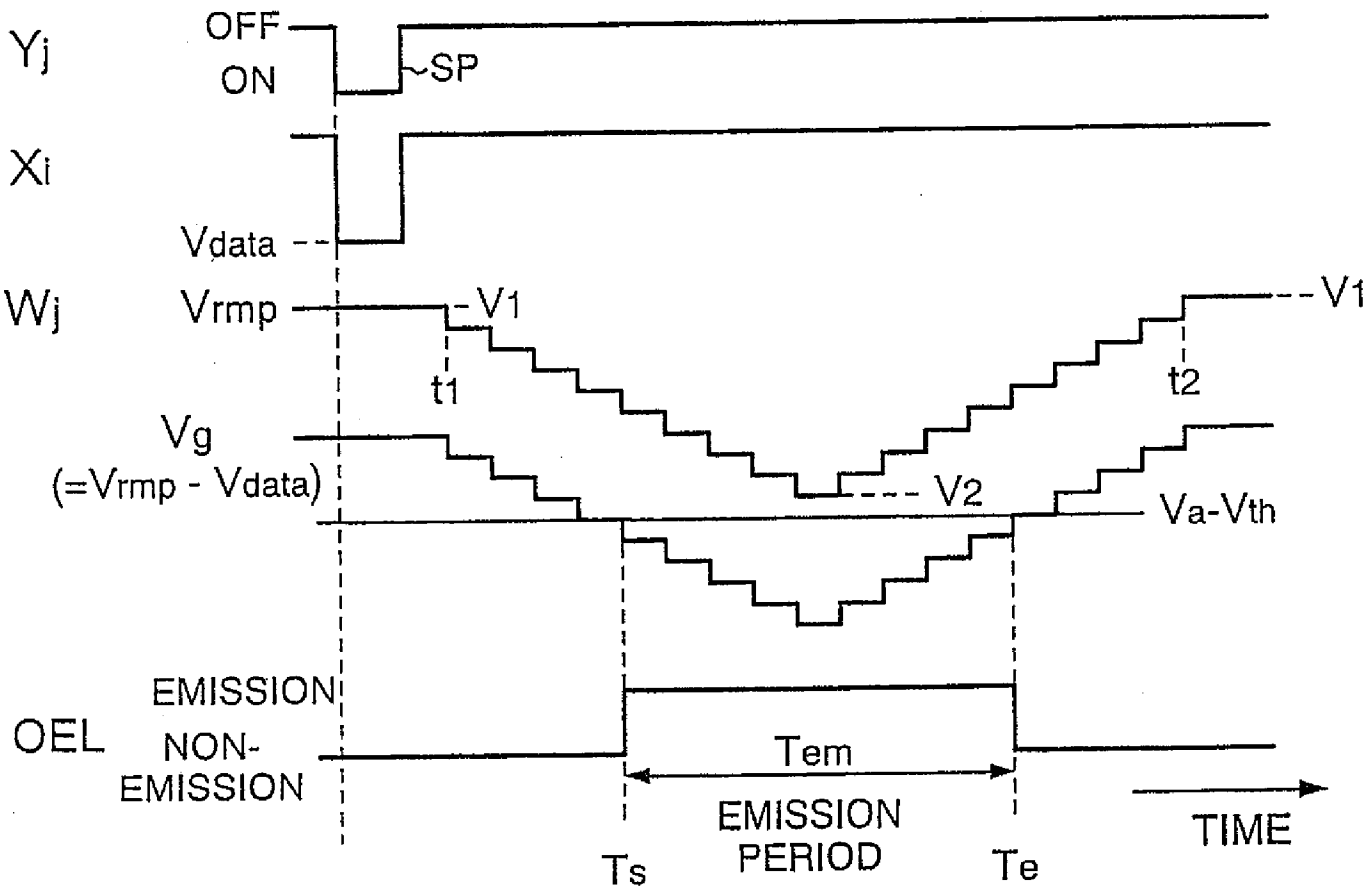
FIG. 9 schematically illustrates light emission control when the ramp voltage Vrmp applied is step voltage which changes stepwise.

The ramp voltage Vrmp is not limited to the slope or gradient voltage which linearly changes as used in the embodiment. The ramp voltage Vrmp may be others such as step voltage which changes stepwise from the voltage V1 to the voltage V2 or from the voltage V2 to the voltage V1 as shown in FIG. 9 as long as the light emission of the light emission elements can be controlled in an equivalent manner to the control of the embodiment. Since step voltage is used in this case, the light emission can be easily controlled by the size and number of the steps.

Alternatively, slope voltage changing curvedly such as voltage exhibiting monotonous curved change can be used as the ramp voltage Vrmp.

Figure 10:
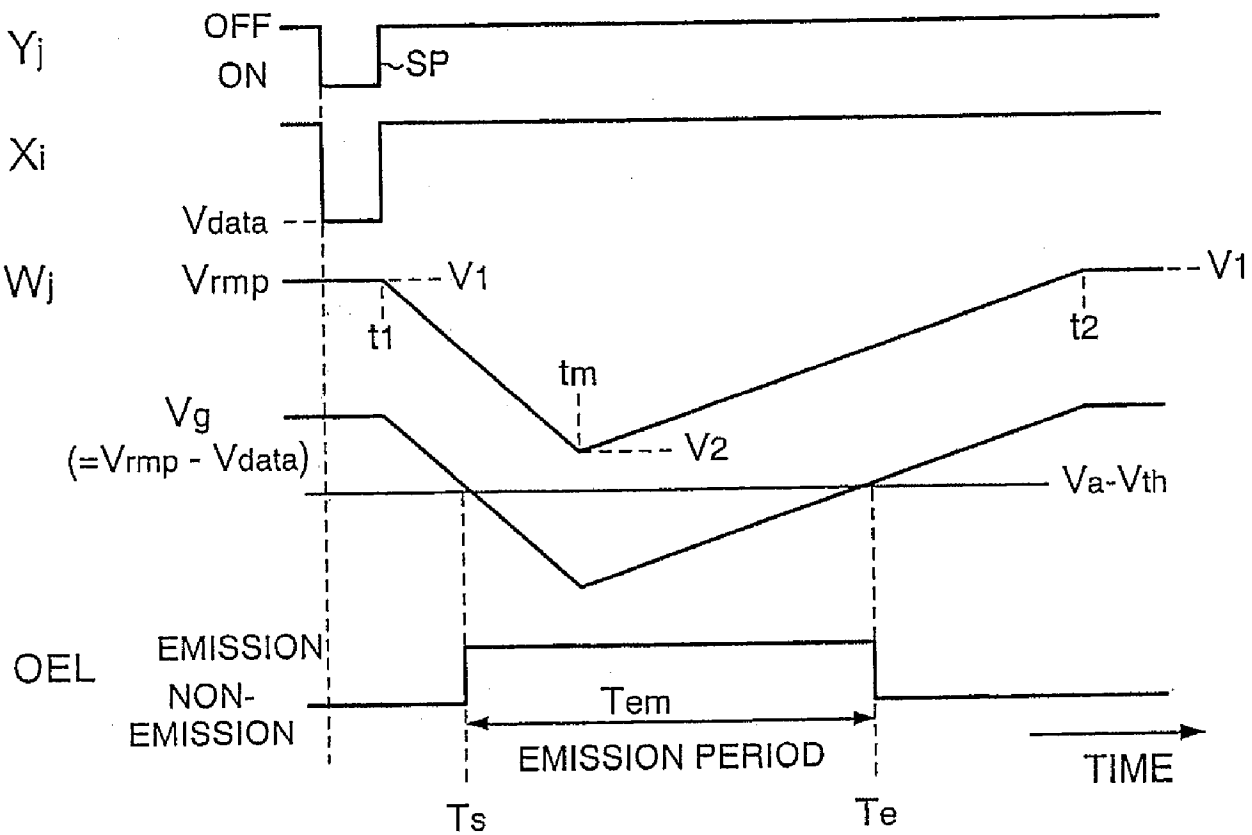
FIG. 10 schematically illustrates light emission control when the ramp voltage has an asymmetrical profile.

The slope of the ramp voltage Vrmp from the voltage V1 to the voltage V2 and the voltage V2 to the voltage V1 are not required to be the same. That is, the voltage profile of the ramp voltage Vrmp during those periods is not required to be symmetrical. For example, as illustrated in FIG. 10, the voltage gradient during the period from the voltage V1 to the voltage V2 (from time t1 to time tm) may be larger than the voltage gradient during the period from the voltage V2 to the voltage V1 (from time tm to time t2). In this case, the light emission start time Ts is positioned earlier than that in the case where the voltage profile is symmetrical (for example, the cases shown in FIGS. 5 and 6 in the first embodiment) even though the lengths of the light emission period (Tem) in both the cases are the same. When ramp voltage Vrmp having a reversed voltage profile is used, the light emission starting time Ts can be delayed though the length of the light emission period (Tem) is equal. Thus, the light emission period (Tem) can be shifted without changing the length of the light emission period by controlling the voltage profile of the ramp voltage Vrmp.

The first embodiment and the modified examples discussed above may be combined for providing appropriate applications.

Second Embodiment

Figure 11:
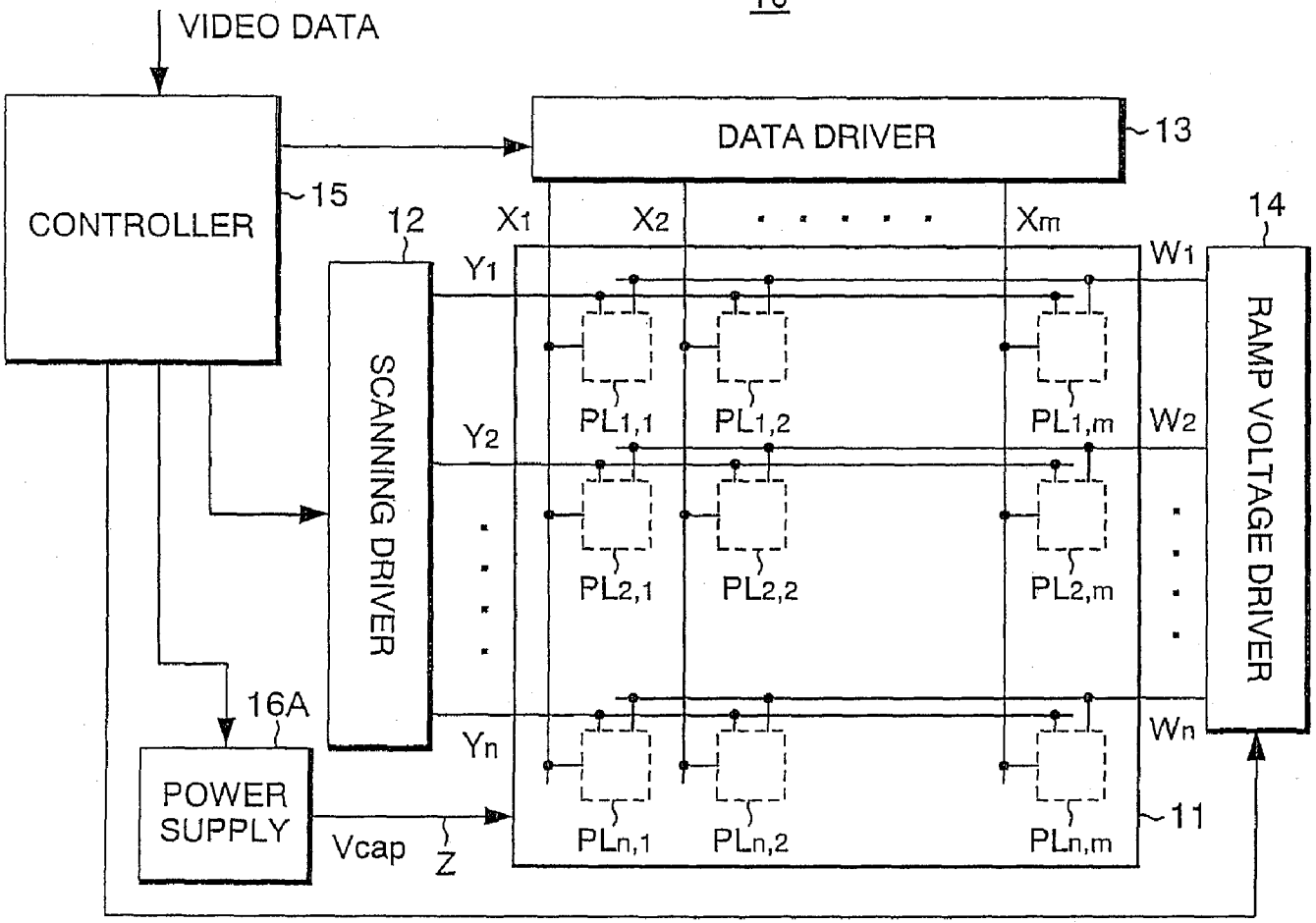
FIG. 11 shows a structure of a display apparatus according to a second embodiment of the present invention.

FIG. 11 illustrates a structure of the display apparatus 10 according to a second embodiment of the present invention. The display apparatus 10 includes the display panel 11, the scanning driver 12, the data driver 13, the ramp voltage driver 14, the controller 15, and a capacitor power supply 16A.

Figure 12:
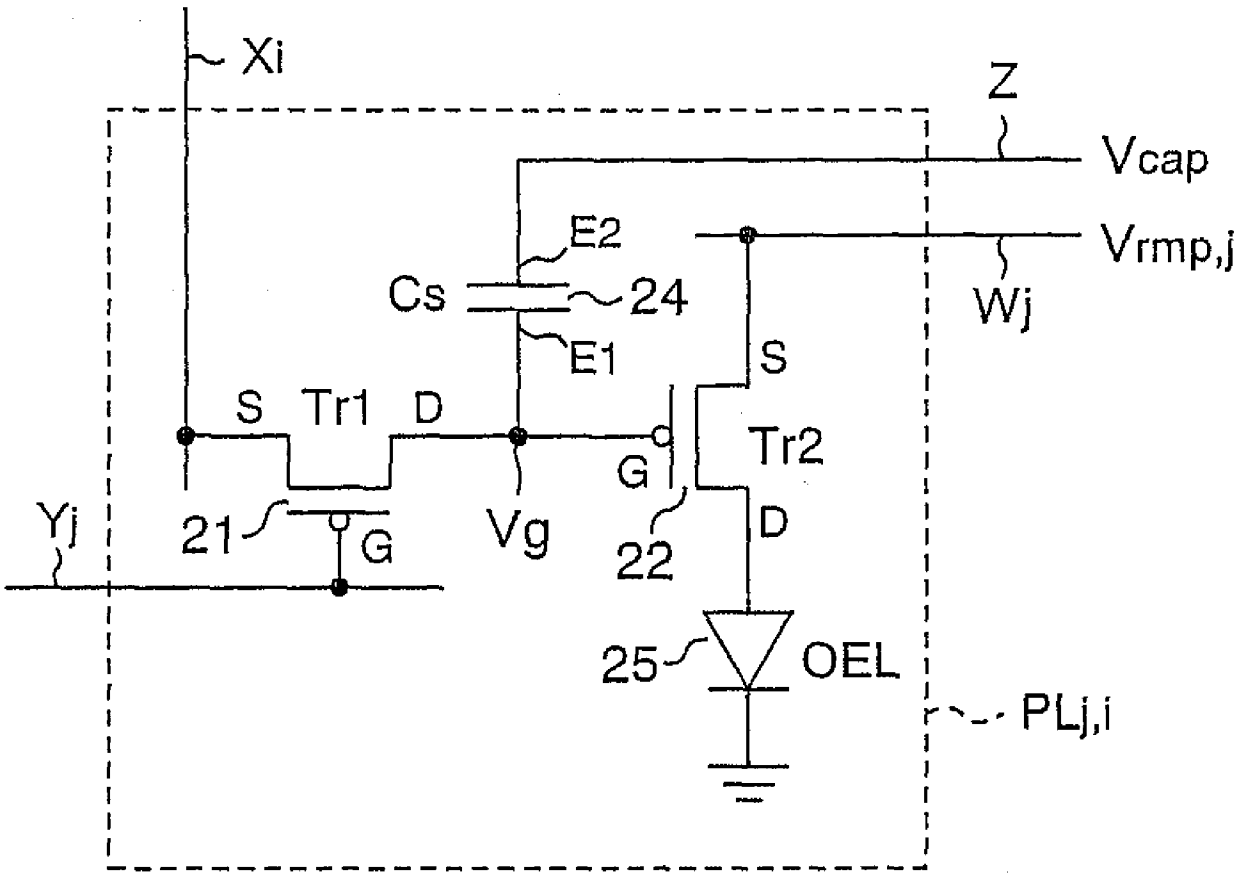
FIG. 12 illustrates a structure of a pixel unit $PL_{j,i}$ connected to a data line Xi and a scanning line Yj in a plurality of pixel units of the display apparatus shown in FIG. 11.

FIG. 12 shows the pixel unit $PL_{j,i}$ connected to the data line Xi (i=1, 2, through m) and the scanning line Yj (j=1, 2 through n) in the plurality of pixel units of the display panel 11. The pixel unit $PL_{j,i}$ has the TFTs (thin film transistors) 21 and 22 as selector transistor (Tr1) and driver transistor (Tr2), respectively, the data holding capacitor (Cs) 24, and the organic EL (electroluminescence) light emission element (OEL) 25 in the same manner as in the first embodiment.

In this embodiment, the second terminals (electrodes E2) of the capacitors (Cs) 24 of all the pixels in the display panel 11 are connected to a common connection line Z. The capacitor power supply 16A applies capacitor voltage Vcap to the common connection line Z. The display panel 11 has the connection lines (ramp voltage lines) W1 through Wn each of which is provided for the corresponding one of the scanning lines Y1 through Yn. In other words, the ramp voltage lines W1 through Wn are common connection lines provided for the corresponding scanning lines. As illustrated in FIG. 12, the source of the driver transistor (Tr2) 22 is connected to the ramp voltage lines W1 through Wn, and the ramp voltage Vrmp is applied to the source of each driver transistor (Tr2) through the corresponding scanning line.

Figure 13:
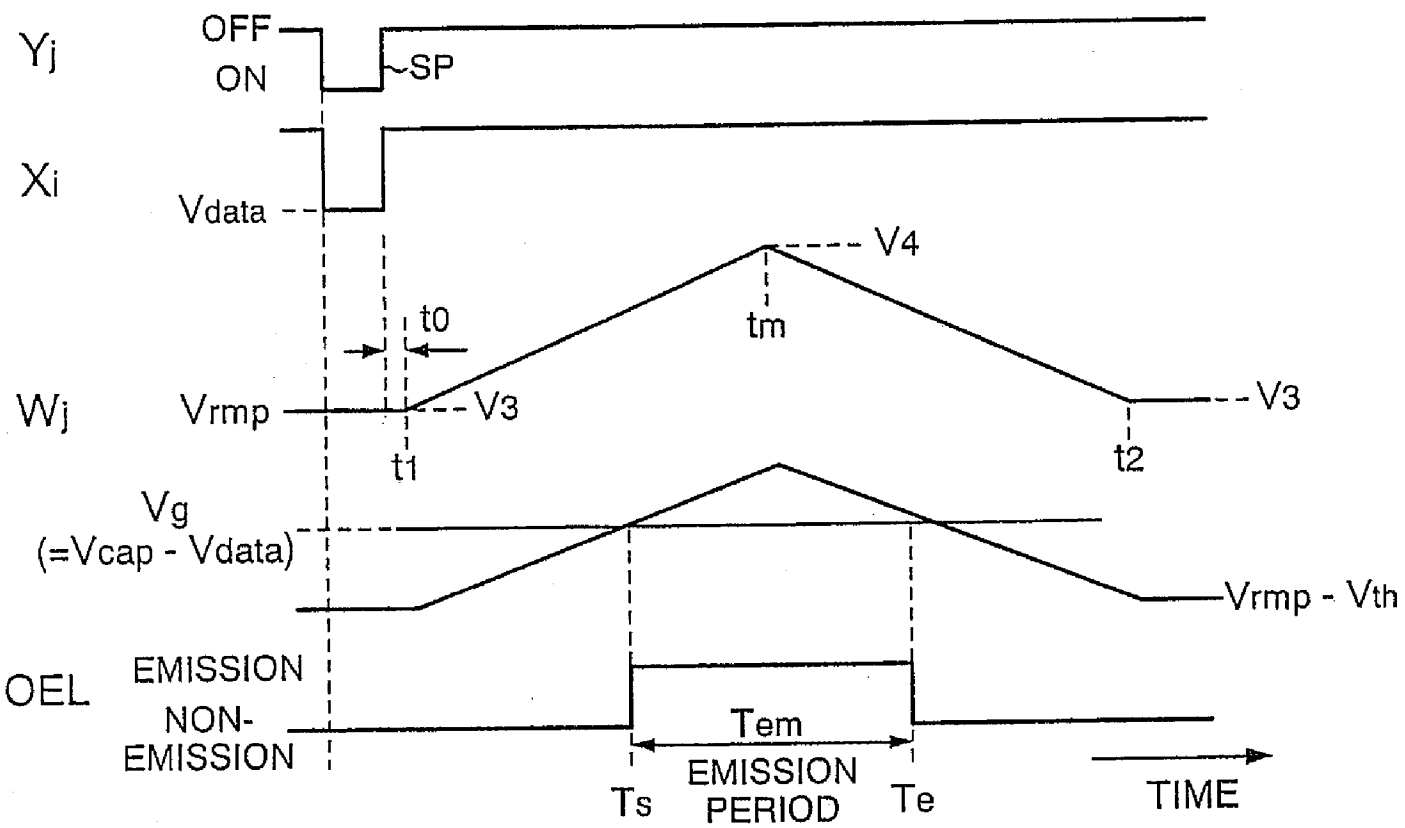
FIG. 13 is a timing chart schematically showing voltage applied to each of lines Yj, Xi and Wj of the pixel unit $PL_{j,i}$, ramp voltage Vrmp, gate voltage Vg of a driver transistor, and a light emission state of a light emission element.

FIG. 13 shows voltages applied to the respective lines Yj, Xi and Wj of the pixel $PL_{j,i}$, the ramp voltage Vrmp, the gate voltage Vg of the driver TFT (Tr2) 22, and the light emission state of the light emission element (OEL) 25.

When the scanning pulse SP is applied to the j-th scanning line Yj (scanning pulse SP is ON), the selector TFT 21 is turned on. Thus, the scanning line Yj is selected, and a data signal (data voltage Vdata) corresponding to the luminance of the pixel $PL_{j,i}$ from the data driver 13 is supplied to the gate of the driver TFT 22 (first terminal: electrode E1) via the selector TFT 21. Since the capacitor voltage Vcap is applied to the second terminal of the capacitor 24 (electrode E2) via the connection line Z, electric charges corresponding to the voltage Vcap−Vdata are accumulated in the capacitor 24 and thus the voltage is held. Drain current corresponding to gate-source voltage Vgs flows in the driver TFT 22. Current (Id) flows in the driver TFT 22 when −Vgs<−Vth. As a result, the light emission element (OEL) 25 is actuated to emit light. That is, the light emission element (OEL) 25 emits light when Vcap−Vdata<Vrmp−Vth.

Similarly to the process in the first embodiment, sweep of the ramp voltage Vrmp is initiated from the end of writing to the pixel $PL_{j,i}$ or from the voltage V3 at the time t1 after elapse of the predetermined time (t0≧0) from the end of the writing. Then, current starts flowing in the driver TFT22 from the time (Ts) when the above condition is satisfied, and thus the light emission element (OEL) 25 starts emitting light. The sweep of the ramp voltage Vrmp is reversed from the voltage V4 to the voltage V3 at the time of tm (Vrmp=V4). Thereafter, the light emission element (OEL) 25 keeps emitting light until the time (Te) when the above condition is not satisfied, and then the light emission element (OEL) 25 stops light emission. Thus, the light emission element (OEL) 25 maintains light emission for the light emission period (length of light emission period Tem) from the light emission start time Ts to the light emission end time Te.

In this embodiment, therefore, the voltage of the second terminal (electrode E2) of the capacitor 24 is fixed and the source voltage of the driver transistor (Tr2) 22 is swept by the ramp voltage Vrmp in the manner opposite to the first embodiment so as to control the timing and length of the light emission period of the light emission elements similarly to the first embodiment.

It is therefore only required to control the control voltage of the driver transistor (Tr2) by the sweep of the ramp voltage Vrmp for each of the scanning lines. In this structure, the switching of the driver transistor (Tr2) is controlled in accordance with the sweep of the ramp voltage Vrmp, and thus the light emission period is controlled accordingly. As a result, the necessity for holding the display data for the frame period is eliminated. Therefore, image quality deterioration and false contour noise which cause blurs of image contours in image display, particularly in moving images display, can be reduced.

Moreover, since the ramp voltage Vrmp is applied to each of the ramp voltage lines W1 through Wn each of which is provided for the corresponding scanning line, the light emission period can be controlled individually for each of the ramp voltage lines (scanning lines). In addition, since the ramp voltage line is provided for each of the scanning lines, the ramp voltage can be applied before the end of the data writing (scanning) to the pixels on all the scanning lines. Thus, similarly to the case shown in FIG. 4, the light emission elements of the pixels connected to the scanning lines to which the data writing is finished emit light within the writing period (or address period: Tadr). Furthermore, the writing period (address period) and the light emission period are not required to be separated. Thus, the light emission period during which the light emission elements emit light is prolonged compared with the light emission period in the case where the writing period and the light emission period are separated, and this prolongation of the light emission increases the luminance. Accordingly, the display apparatus can achieve high-performance luminance control such as high-accuracy luminance control with high luminance.

Similarly to the first embodiment, the types and polarities of the transistors and light emission elements and the levels and polarities of the scanning pulse SP, data voltage Vdata and ramp voltage Vrmp, and other conditions are only examples shown for the purpose of explanation. The polarities of the elements, the levels and polarities of the voltage and other conditions selected may be others as long as the switching of the driver transistor (Tr2) is controlled and the emission and non emission states of the light emission elements are switched in accordance with the level of the data voltage Vdata and the sweep of the ramp voltage Vrmp so as to control the length of the light emission period of the light emission elements in accordance with the levels of the data voltage Vdata.

In this embodiment, the constant voltage (Vcap) is applied to the second terminal (electrode E2) of the capacitor (Cs) 24 of all the pixels in the display panel 11, and the ramp voltage Vrmp,j is applied to the source of each driver transistor (Tr2) through the corresponding ramp voltage lines Wj (j=1 through n) as the common connection lines each of which is provided for the corresponding scanning line. Thus, switching of the driver transistor (Tr2), i.e., switching of the light emission state is controlled by varying the gate to source voltage (gate-source voltage Vgs) of the driver transistor (Tr2).

Third Embodiment

Figure 14:
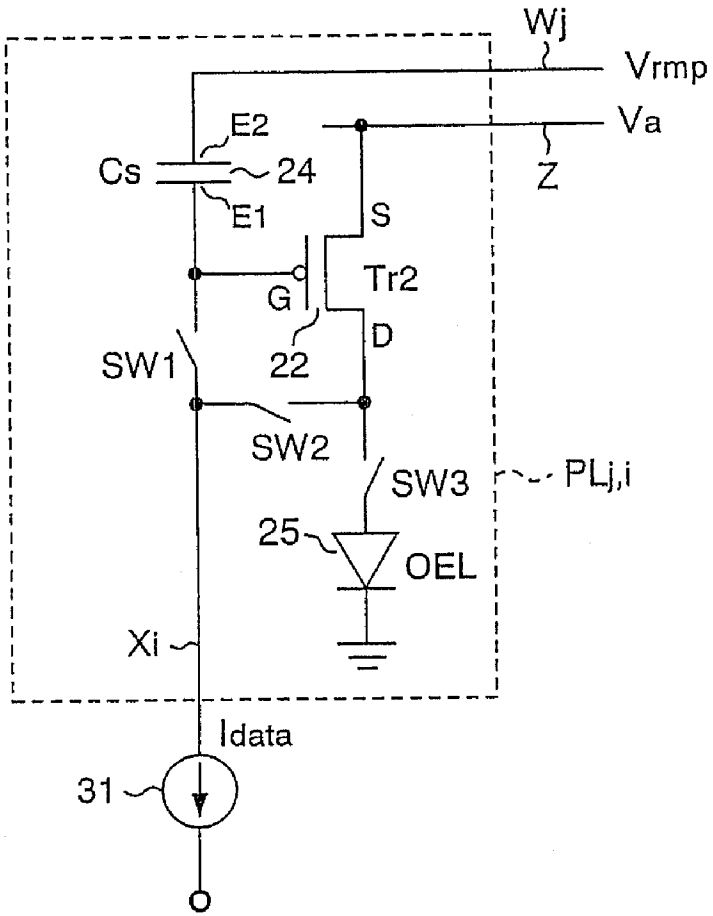
FIG. 14 shows a pixel unit $PL_{j,i}$ connected to a data line Xi (i: 1, 2 through m) and a scanning line Yj (j=1,2 through n) according to a third embodiment of the present invention.

FIG. 14 illustrates the pixel unit $PL_{j,i}$ connected to the data line Xi (i=1, 2, through m) and the scanning line Yj (j=1, 2 through n) in the plurality of pixel units of the display panel 11 according to a third embodiment of the present invention.

The analog driving system which writes analog data to pixels and modulates light emission luminance by an analog method for luminance control involves a current designation type which uses current for data designation as well as the voltage designation type discussed above which uses voltage for data designation. According to this analog driving system, variations in the characteristics of the TFTs, the organic EL elements and the like are the problems. For compensating for the variations in the element characteristics of the TFTs and the like, voltage program method and current program method are used in some cases. For example, current program type and voltage program type proposed by Sarnoff Corp. et al. and disclosed in Digest IEDM98 pp. 875-878 of International Electron Devices Meeting (IEDM) are used.

In the embodiment, the display panel 11 has a circuit structure in conformity with the so-called current program method. More specifically, the pixel unit $PL_{j,i}$ has the driver transistor (Tr2) 22, the capacitor (Cs) 24, a current supply 31, and switches SW1 through SW3 each of which is constituted by a transistor such as TFT. Thus, the pixel unit $PL_{j,i}$ is constituted as a four-transistor current program pixel circuit.

The data driver 13 is provided as a constant current supply, and the current supply 31 corresponding to the data line Xi of the data driver 13 supplies data current Idata to the pixel unit $PL_{j,i}$.

Similarly to the structure of the first embodiment, the source of the driver transistor (Tr2) 22 is connected to the power supply line Z, and the second terminal (electrode E2) of the capacitor (Cs) 24 is connected to the ramp voltage line Wj. Thus, the ramp voltage driver 14 applies the ramp voltage Vrmp,j to the capacitor (Cs) 24 via the ramp voltage line Wj.

The switches SW1 through SW3 are connected and disconnected in response to the scanning pulse signals from the scanning driver 12 and/or the control signals from the controller 15. More specifically, the states of ON/OFF of the switches SW1 through SW3 are controlled in accordance with the data writing mode for writing data to the capacitor (Cs) 24 or the light emission mode for generating light emission of the light emission element (OEL) 25.

Figure 15:
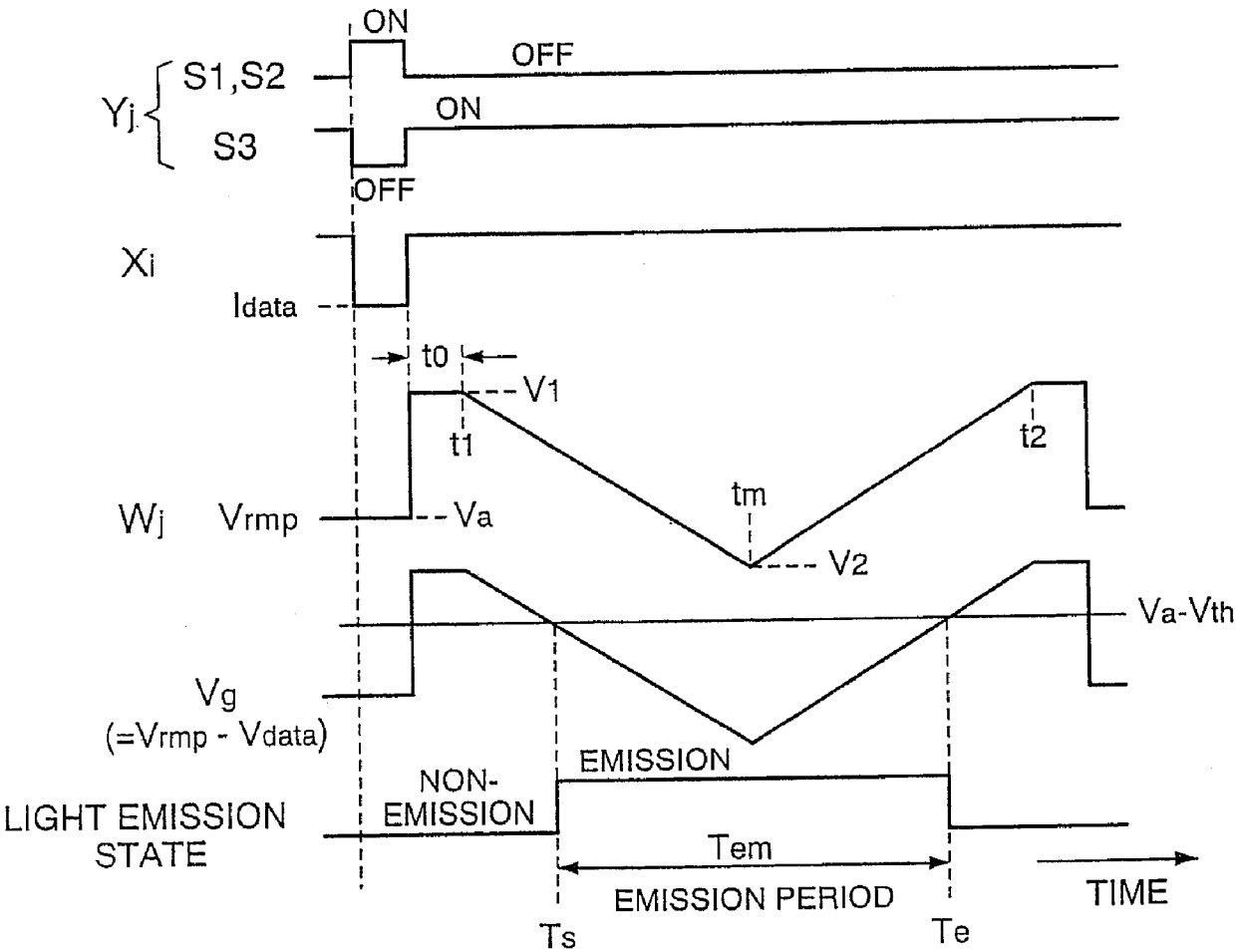
FIG. 15 is a timing chart schematically showing states of switches SW1 through SW3, a data line Xi, ramp voltage Vrmp applied, gate voltage Vg of a driver transistor, and a light emission state of a light emission element.

The light emission control of the embodiment is now described in more detail with reference to FIGS. 15 and 16. FIG. 15 shows the ON/OFF states of the switches SW1 through SW3, the data line Xi, the ramp voltage Vrmp applied to the ramp voltage line Wj, the gate voltage Vg of the driver TFT (Tr2) 22, and the light emission state of the light emission element (OEL) 25.

Initially, the switches SW1 and SW2 are connected (ON) in response to a scanning control signal for selecting the j-th scanning line Yj and the switch SW3 is disconnected (OFF) in the data writing mode. By this process, the data current Idata is supplied to the data line Xi and data is written. During this step, the switch SW3 is turned off and therefore the light emission element (OEL) 25 does not emit light.

Then, charges corresponding to the voltage Vrmp-Vdata are accumulated in the capacitor 24 by the supply of the data current Idata, and this voltage is held. After the data writing effected by the supply of the data current Idata is finished, the ramp voltage Vrmp is temporarily set at a voltage (V1) such that the driver TFT 22 is not conductive.

Sweep of the ramp voltage Vrmp is initiated from the end of writing to the pixel $PL_{j,i}$ or from the voltage V1 at the time t1 after elapse of the predetermined time from the end of the writing. Then, current starts flowing in the driver TFT22 from the time (Ts) when the condition Vrmp−Vdata<Va−Vth that the driver TFT 22 becomes conductive is satisfied, and thus the light emission element (OEL) 25 starts emitting light. The sweep of the ramp voltage Vrmp is reversed from the voltage V2 to the voltage V1 at the time of tm (Vrmp=V2). Thereafter, the light emission element (OEL) 25 keeps emitting light until the time (Te) when the above condition is not satisfied, and then the light emission element (OEL) 25 stops light emission. Thus, the light emission element (OEL) 25 maintains light emission for the light emission period (length of light emission period Tem) from the light emission start time Ts to the light emission end time Te.

Thus, as discussed above, the display apparatus of the invention is applicable to the current writing type (current designation type) display apparatus. More specifically, the current writing type display apparatus controls the light emission period in the same manner as in the voltage writing type display apparatus explained in the first and second embodiments. That is, the current writing type display apparatus varies the light emission states of the light emission elements by changing the control electrode voltages of the driver transistors relative to the other electrode voltages similarly to the voltage writing type display apparatus.

As discussed above, the display apparatus of the invention is applicable to the display apparatus having the compensating circuit for compensating for the variations in the element characteristics of the driver transistors and others. The display apparatus of the embodiment is applicable to the voltage program type as well as the current program type.

The display apparatus of the invention is applicable not only to the voltage program type and current program type but also to various types of voltage program pixel circuit and current program pixel circuit. For example, the display apparatus of this embodiment is applicable to a current mirror pixel circuit and the like.

In the description of the embodiment, the types and polarities of the transistors and light emission elements and the levels and polarities of the scanning pulse SP, data voltage Vdata and ramp voltage Vrmp, and other conditions are only examples shown for the purpose of explanation. The polarities of the elements, the levels and polarities of the voltage and other conditions selected may be others as long as the switching of the driver transistor (Tr2) is controlled and the emission and non emission states of the light emission elements are switched in accordance with the level of the data voltage Vdata and the sweep of the ramp voltage Vrmp so as to control the length of the light emission period of the light emission elements in accordance with the levels of the data voltage Vdata.

By the light emission control of the embodiment, the display data is not required to be held for the frame period, and therefore image quality deterioration and false contour noise which cause blurs of image contours in image display, particularly in moving images display, can be reduced.

The display apparatus of the embodiment offers the same various advantages as those provided by the display apparatuses of the first and second embodiments. For example, the light emission period can be controlled for each of the scanning lines. Moreover, the light emission elements emit light even within the writing period (address period: Tadr). Since the address period and the light emission period are not required to be separated, the light emission period is prolonged compared with the light emission period in the case where the writing period and the light emission period are separated. As a result, the luminance increases.

Accordingly, the display apparatus of the embodiment can achieve high-performance luminance control such as high-accuracy luminance control with high luminance and low power consumption while offering the advantage of eliminating image quality deterioration. Furthermore, the display apparatus has simplified circuit structure and operation.

Fourth Embodiment

Figure 17:
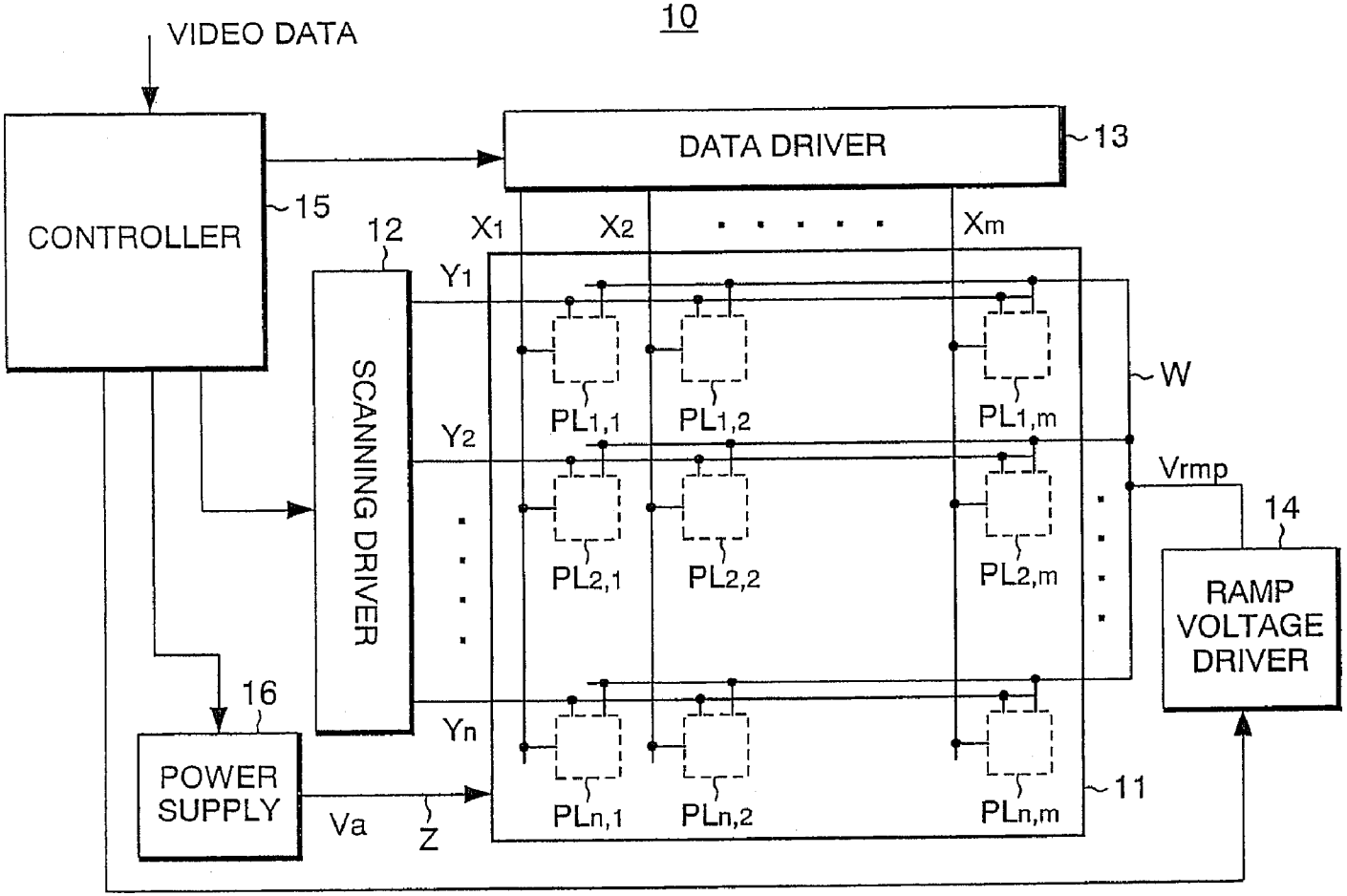
FIG. 17 shows a structure of a display apparatus according to a fourth embodiment of the present invention.

FIG. 17 illustrates a structure of the display apparatus 10 according to a fourth embodiment of the present invention. The display apparatus 10 includes the display panel 11, the scanning driver 12, the data driver 13, the ramp voltage driver 14, the controller 15, and the capacitor power supply 16A.

Figure 18:
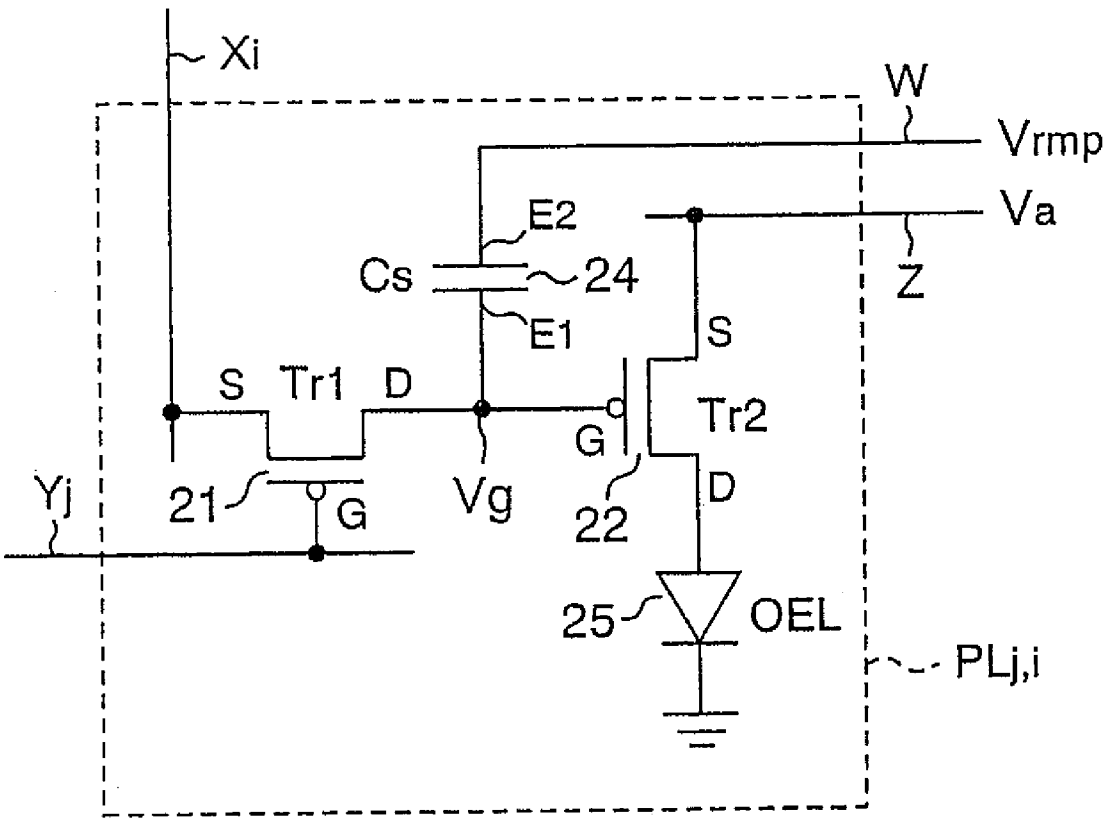
FIG. 18 illustrates a structure of a pixel unit $PL_{j,i}$ connected to a data line Xi and a scanning line Yj in a plurality of pixel units of the display apparatus shown in FIG. 17.

FIG. 18 illustrates the pixel unit $PL_{j,i}$ connected to the data line Xi (i=1, 2, through m) and the scanning line Yj (j=1, 2 through n) in the plurality of pixel units of the display panel 11. The pixel unit $PL_{j,i}$ has the TFTs (thin film transistors) 21, 22 which are the selector transistor (Tr1) and the driver transistor (Tr2), respectively, the data holding capacitor (Cs) 24, the organic EL (electroluminescence) light emission element (OEL) 25 similarly to the first and other embodiments.

In this embodiment, the electrodes E2 of the capacitors (Cs) 24 of all the pixel units $PL_{1,1}$ through $PL_{n,m}$ are connected to the ramp voltage driver 14 via a ramp voltage line W. Thus, the ramp voltage line W as a common connection line is connected to the capacitors 24 of all the pixel units $PL_{1,1}$ through $PL_{n,m}$ of the display panel 11. The capacitors 24 of all the pixels in the display panel 11 are connected such that the ramp voltage driver 14 can apply the ramp voltage Vrmp to the capacitors 24. The sources of the driver transistors (Tr2)

22 of all the pixels are connected to the power supply line Z. The power supply (PS) 16 supplies light emission element driving voltage (Va) to the power supply line Z.

Figure 19:
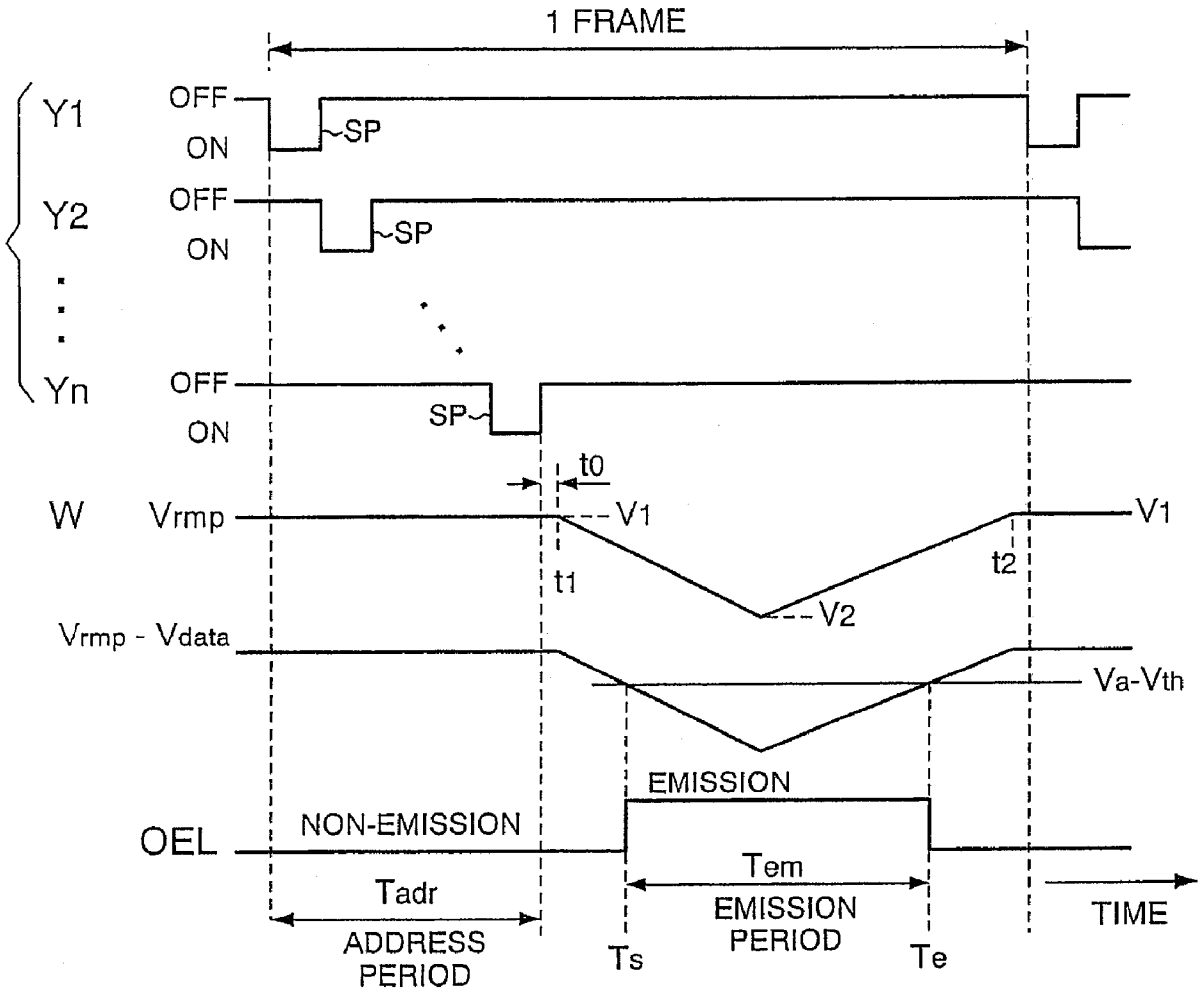
FIG. 19 is a timing chart schematically showing timing for applying scanning pulse to each of scanning lines Y1 through Yn and ramp voltage Vrmp to a ramp voltage line W, and a light emission state of a light emission element.

FIG. 19 is a timing chart schematically showing the timing for applying the scanning pulses to the respective scanning lines Y1 through Yn and the ramp voltage Vrmp to the ramp voltage line W, and the light emission state of the light emission element (OEL) 25.

In each frame of the input video signal, the scanning pulse SP is sequentially applied to the first through the nth scanning lines (Y1 through Yn) (address period: Tadr) for the line sequential scanning. Then, the data driver 13 supplies data voltage (not shown) at the time of selection of the scanning lines, and pixel data is written. The address period (Tadr) is a period from the start of the data writing (scanning) to the pixels on all the scanning lines (Y1 through Yn) to the end of the data writing.

After the address period is finished, the ramp voltage driver 14 sweeps the ramp voltage Vrmp on the ramp voltage line W. More specifically, sweep of the ramp voltage Vrmp is initiated from the end of the address period or from the voltage V1 at the time t1 after elapse of the predetermined time from the end of the address period. Then, current starts flowing in the driver TFT22 at the ramp voltage sufficient for turning on the driver TFT 22 and thus the light emission element (OEL) 25 starts emitting light (time Ts). The sweep of the ramp voltage Vrmp is reversed from the voltage V2 to the voltage V1 at the time of tm (Vrmp=V2). Thereafter, the light emission element (OEL) 25 keeps emitting light until the time (Te) when the above condition is not satisfied, and then the light emission element (OEL) 25 stops light emission. Thus, the light emission element (OEL) 25 maintains light emission for the light emission period (length of light emission period Tem) from the light emission start time Ts to the light emission end time Te.

As discussed above, the light emission period can be controlled by a simple structure which applies the common ramp voltage Vrmp to the capacitors 24 of all the pixels of the display panel 11 via the ramp voltage line W as the common connection line. Thus, the display apparatus of the embodiment can reduce image quality deterioration and false contour noise which cause blurs of image contours, and provide high-quality image display.

The same advantages as in this embodiment can be offered when the voltage of the second terminal (electrode E2) of the capacitor 24 is fixed and the source voltage of the driver transistor (Tr2) 22 receives the sweep of the ramp voltage Vrmp in the same manner as in the second embodiment.

What is claimed is:

1. A display apparatus, comprising:

an active matrix display panel including light emission element driving circuits having capacitors for holding a data signal and driver transistors for driving light emission elements based on data signal voltage held by the capacitors, and a plurality of pixel units each of which has the light emission element and is arranged in matrix with lines and rows;

a scanning driver for sequentially scanning each of scanning lines provided for the corresponding line of the pixel units;

a data driver for supplying the data signal to the pixel units via data lines in response to scanning by the scanning driver;

ramp voltage lines each of which is provided for the corresponding scanning line of the display panel and is connected to the light emission element driving circuit;

a ramp voltage generating section for generating ramp voltage which varies the control electrode voltage of the driver transistor relative to the voltage of the source electrode of the driver transistor to change the light emission state of the light emission elements; and a ramp voltage driver for supplying the ramp voltage to each of the ramp voltage lines provided for the corresponding scanning line in response to the scanning of the scanning lines, wherein:

each of the first terminals of the capacitors is connected to the control electrode of the driver transistor;

each of second terminals of the capacitors is connected to a predetermined voltage; and the source electrode of the driver transistor is connected to the corresponding ramp voltage line provided for the corresponding scanning line of the display panel and receives the ramp voltage.

2. A display apparatus, comprising:

an active matrix display panel including light emission element driving circuits having capacitors for holding a data signal and driver transistors for driving light emission elements based on data signal voltage held by the capacitors, and a plurality of pixel units each of which has the corresponding light emission element and is arranged in matrix with lines and rows;

a scanning driver for sequentially scanning each of scanning lines provided for the corresponding line of the pixel units;

a data driver for supplying the data signal to the pixel units via data lines in response to scanning by the scanning driver;

ramp voltage lines each of which is provided for the corresponding scanning line of the display panel and is connected to the corresponding light emission element driving circuit;

a ramp voltage generating section for generating ramp voltage which varies the control electrode voltage of the driver transistor relative to the voltage of the source electrode of the driver transistor to change the light emission state of the light emission elements; and a ramp voltage driver for applying the ramp voltage to the source electrodes of all the driver transistors, wherein:

each of the first terminals of the capacitors is connected to the control electrode of the corresponding driver transistor; and each of second terminals of the capacitors is connected to a predetermined voltage.

3. A display apparatus according to claim 1, wherein the ramp voltage generating section controls the ramp voltage such that the light emission element of the pixel unit connected to at least one scanning line starts emitting light within a writing period for scanning all the scanning lines of the display panel.

4. A display apparatus according to claim 1, wherein the ramp voltage generating section controls the light emission timing for the light emission elements by varying the gradient of the ramp voltage.

5. A display apparatus according to claim 1, wherein the ramp voltage generating section controls the ramp voltage such that the total light emission amount of the light emission elements during the light emission period corresponds to the luminance indicated by the data signal.

6. A display apparatus according to claim 1, wherein the ramp voltage has a triangular-wave profile.

7. A driving method of a display apparatus which includes:

an active matrix display panel having a plurality of pixel units each of which has a light emission element, a capacitor for holding a data signal, and a driver transistor for driving the light emission element based on data signal voltage held by the capacitor and is arranged in matrix with lines and rows; a scanning driver for sequentially scanning each of scanning lines provided for the corresponding line of the pixel units; and a data driver for supplying the data signal to the pixel units via data lines in response to scanning by the scanning driver, comprising:

a step of controlling the capacitors such that the capacitors hold voltages in accordance with the data signal;

a ramp voltage generating step of generating ramp voltage which varies the control electrode voltage of the driver transistor relative to the voltage of the source electrode of the driver transistor to change the light emission state of the light emission elements; and a ramp voltage applying step of applying the ramp voltage to the source electrode of the corresponding driver transistor for each of the scanning lines in response to the scanning of the scanning lines of the display panel, wherein:

each of the first terminals of the capacitors is connected to the control electrode of the corresponding driver transistor;

each of second terminals of the capacitors is connected to a predetermined voltage.

8. A driving method of a display apparatus which includes: an active matrix display panel having a plurality of pixel units each of which has a light emission element, a capacitor for holding a data signal, and a driver transistor for driving the light emission element based on data signal voltage held by the capacitor and is arranged in matrix with lines and rows; a scanning driver for sequentially scanning each of scanning lines provided for the corresponding line of the pixel units; and a data driver for supplying the data signal to the pixel units via data lines in response to scanning by the scanning driver, comprising:

a step of controlling the capacitors such that the capacitors hold voltages in accordance with the data signal;

a ramp voltage generating step of generating ramp voltage which varies the control electrode voltage of the driver transistor relative to the voltage of the source electrode of the driver transistor to change the light emission state of the light emission elements; and a ramp voltage applying step of applying the ramp voltage to the source electrodes of all the driver transistors, wherein:

each of the first terminals of the capacitors is connected to the control electrode of the corresponding driver transistor; and each of second terminals of the capacitors is connected to a predetermined voltage.

9. A driving method according to claim 7, wherein the ramp voltage generating step adjusts the ramp voltage such that the light emission element of the pixel unit connected to at least one scanning line starts emitting light within a writing period for scanning all the scanning lines of the display panel.

10. A driving method according to claim 9, wherein the ramp voltage generating step adjusts the ramp voltage such that the light emission element of the pixel unit connected to at least one scanning line starts emitting light within a writing period for scanning all the scanning lines of the display panel.

* * * * *